US007445491B2

(12) United States Patent
Fujii et al.

(10) Patent No.: US 7,445,491 B2
(45) Date of Patent: Nov. 4, 2008

(54) CONNECTOR AND A CONNECTOR ASSEMBLY

(75) Inventors: Masayasu Fujii, Yokkaichi (JP); Toshikazu Sakurai, Yokkaichi (JP); Atsushi Sakatani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 120 days.

(21) Appl. No.: 11/542,039

(22) Filed: Oct. 3, 2006

(65) Prior Publication Data

US 2007/0072482 A1 Mar. 29, 2007

(30) Foreign Application Priority Data

Sep. 29, 2005 (JP) ..... 2005-285116
May 24, 2006 (JP) ..... 2006-144469

(51) Int. Cl.
*H01R 3/00* (2006.01)

(52) U.S. Cl. ..... 439/489; 439/188; 439/157

(58) Field of Classification Search ..... 439/188, 439/489, 157
See application file for complete search history.

(56) References Cited

U.S. PATENT DOCUMENTS 5,743,760 A 4/1998 Inaba et al.
6,257,922 B1 7/2001 Shinozaki
6,361,356 B1 3/2002 Heberlein et al.
6,371,796 B2 * 4/2002 Fukuda ..... 439/188
6,705,881 B2 * 3/2004 Tsuchiya ..... 439/157
6,712,635 B1 * 3/2004 Nimura ..... 439/489
2003/0162413 A1 8/2003 Shinozaki et al.

FOREIGN PATENT DOCUMENTS

JP 2003-086301 3/2003

* cited by examiner

*Primary Examiner*—Briggitte R Hammond
(74) *Attorney, Agent, or Firm*—Gerald E. Hespos; Anthony J. Casella

(57) ABSTRACT

A lever (40) formed with a cam groove (41) is rotatably mounted and a detecting terminal (60) is mounted in a female housing (10). The detecting terminal (60) contacts contact terminals (98) in the female housing (10) to close a detecting circuit only when the housings (10, 80) are connected properly. A pressing portion (44) projects from part of a cam plate (47) of the lever (40) facing the detecting terminal (60), and keeps pressing the detecting terminal (60) to deform the detecting terminal 60 to a position where the detecting terminal (60) is separated from the contact terminals (98) while the lever (40) is rotated until the housings (10, 80) are connected properly. The pressed state is canceled to enable the detecting terminal (60) to contact the contact terminals (98) when the lever 40 is rotated to a position where the housings (10, 80) are connected properly.

13 Claims, 30 Drawing Sheets

CONNECTOR AND A CONNECTOR ASSEMBLY

BACKGROUND OF THE INVENTION

1. Field of the Invention

The invention relates to a connector of the movable member type, particularly to a lever-type connector.

2. Description of the Related Art

Japanese Unexamined Patent Publication No. 2003-86301 discloses a lever-type connector with first and second housings. A lever is supported rotatably on the first housing and is formed with a cam groove that can engage a cam pin on the second housing. The housings are fit lightly together so that the cam pin enters the cam groove. The lever then is rotated to generate a cam action between the cam groove and the cam pin for pulling the housings towards each other.

The lever has a detector that is displaceable from a standby position to a detecting position. The detector can be displaced from the standby position to the detecting position when the lever reaches a position where the housings are connected properly. However, displacement of the detector from the standby position to the detecting position is prevented when the lever is left at a partly connected position. In other words, the rotational position of the lever can be detected based on whether or not the detector can be displaced to the detecting position. Accordingly, an operator will not end a lever rotating operation while the housings are left only partly connected without the lever being rotated completely to the properly connected position.

In the above case, proper connection of the housings is detected mechanically based on the rotational position of the lever. However, a demand also exists to detect proper connection of the housings electrically.

The present invention was developed in view of the above problem and an object thereof is to provide a connector of the movable member type and a respective connector assembly capable of electrically detecting whether or not two connector housings are properly connected.

SUMMARY OF THE INVENTION

The invention relates to a connector with a housing that is connectable with a mating housing. A movable member, such as a lever or a slider, is mounted movably to the housing. The movable member is formed with a cam, such as a cam groove, that is engageable with a mating cam, such as a cam pin, on the mating housing. The connector further includes a detecting terminal for electrically detecting proper connection of the housing with the mating housing. The detecting terminal contacts a contact terminal in either the housing or the mating housing to close a detecting circuit only when the housings are connected properly. A pressing portion is arranged at a part of the movable member to face the detecting terminal. The pressing portion presses and resiliently displaces the detecting terminal away from the contact terminal until the movable member has been moved sufficiently to connect the housings. However, the pressing portion stops pressing the detecting terminal when the movable member is moved to a position where the housings are connected properly. Thus, the detecting terminal is restored resiliently and contacts the contact terminal.

The housings are fit lightly together so that the cam starts cooperating with the mating cam. The movable member then is moved so that the cam interacts with the mating cam to urge the housing towards the mating housing. The pressing portion on the movable member presses and displaces the detecting terminal during this movement so that the detecting terminal is separated from the contact terminal. The pressing portion stops pressing the detecting terminal when the movable member has moved sufficiently to connect the housings properly. As a result, the detecting terminal is restored and contacts the contact terminal to close the detecting circuit. Thus, the properly connected state of the housings can be detected electrically.

The movable member preferably has at least one locking piece that is resiliently deformable in the thickness direction of the movable member. The locking piece moves onto a lock projection on the mating housing during connection of the housings. However, the locking piece moves over the lock projection when the housings are connected properly, and is restored to engage the lock projection and to hold the housings together. The pressing portion preferably is on a surface of the locking piece that faces the detecting terminal. Accordingly, the pressing portion on the locking piece presses the detecting terminal and holds the detecting terminal separated from the contact terminal. The locking piece moves over the locking projection and is restored when the housings are connected properly, and thus the pressing portion stops pressing the detecting terminal. Therefore, the detecting terminal is restored into electrical connection with the contact terminal and closes the detecting circuit.

As described above, resilient movements of the locking piece are used as an indicator of proper connection of the housings. Thus, detection capability cannot be affected by an assembling error of the movable member, and the properly connected state can be detected precisely. This distinguishes from connectors where the position of the movable member (such as the angular position of the lever) is detected and the detected position is an indicator of proper connection.

The locking piece preferably starts moving onto the lock projection and resiliently deforms at an intermediate stage of the connection of the housings. Additionally, a pre-pressing portion is provided on the locking piece before the pressing portion for pressing the detecting terminal and holding the detecting terminal separated from the contact terminal. The pre-pressing portion preferably is at a side of the movable member before the locking piece with respect to a connecting direction.

The detecting terminal could be in contact with the contact terminal after the start of the connecting operation if the locking piece starts deforming after the start of the connecting operation. However, the pre-pressing portion separates the detecting terminal and the contact terminal until the locking piece starts to deform. Thus, an incorrect indication of proper connection will not be provided during the connection. In other words, secure detection is achieved by enlarging an operation range where connection detection can be made.

The detecting terminal preferably is assembled into the housing substantially along a connecting direction of the connector with the mating housing and the contact terminal preferably is in the mating housing. The preferred detecting terminal includes a base plate to fix the detecting terminal to the housing. A first resiliently deformable spring extends back from the front of the base plate for contacting the contact terminal, and a second resiliently deformable spring extends forward from the back of the base plate. A front end of the second spring preferably is placed on the rear end of the first spring at a side toward the movable member. A pressable portion is formed at a longitudinal intermediate position of the second spring and can be pressed by the pressing portion. The pressing portion preferably slidably presses the pressable portion along a movement path from the rear towards the front with respect to the connecting direction of the housing when the movable member is displaced from an initial position to a connection ending position. A backward projecting amount of the movable member from the housing is relatively large at the initial position, but is relatively small at a connection ending position.

Accordingly, the movable member has moved to the connection ending position when the connecting operation of the both housings is completed. The backward projecting amount of the movable member from the housing preferably is relatively small at this position. Thus, the entire connector can be small. With such a construction, the pressing portion of the movable member contacts the pressable portion from behind when the movable member is operated and slides thereon along the movement path. The second spring extends along the sliding direction and hence can be deformed easily. Conversely, the first spring extends back and can contact the contact terminal with sufficient contact pressure at an early stage of the connecting operation.

According to a further aspect of the invention, the movable member includes at least one pressing portion at a side that has the detecting terminal. A resiliently deformable movable arm is provided in the housing between the pressing portion and the detecting terminal. The pressing portion presses the movable arm to incline the movable arm towards the detecting terminal and the inclined movable arm presses the detecting terminal to hold the detecting terminal deformed to a position away from the contact terminal until the movable member is moved sufficiently to connect the housings properly. The detecting terminal is restored and contacts the contact terminal as the pressing portion stops pressing to restore the movable arm when the movable member is moved sufficiently to connect the housings properly.

Accordingly, the housings are fit lightly together so that the cam starts cooperating with the mating cam. The movable member is operated in this state so that the cam cooperates with the mating cam to connect the housings. During this time, the pressing portion on the movable member presses the movable arm of the housing to incline the movable arm towards the detecting terminal. The movable arm then presses and resiliently deforms the detecting terminal. Thus, the detecting terminal and the contact terminal are held separated. The pressing portion stops pressing and the movable arm restores when the movable member is moved sufficiently to connect the housings properly. Accordingly, the detecting terminal is restored resiliently to contact the contact terminal and to close the detecting circuit. As a result, the properly connected state of the housings can be detected electrically.

Deformation of the detecting terminal could be thrown out of balance if no movable arm was provided and if the pressing portion directly contacted the detecting terminal since the pressing portion is displaced on the detecting terminal as the movable member is operated. However, the movable arm of the subject invention is between the detecting terminal and the pressing portion and the detecting terminal is pressed by the movable arm. Thus, the movable arm is held in contact with the detecting terminal at a constant position and the detecting terminal can be deformed in a well-balanced manner. The movable arm also is useful if the pressing portion cannot reach a position for directly contacting the detecting terminal due to restriction on the structural space.

The pressing portion preferably is on a surface of the locking piece facing the movable arm. The movable arm extends back from a support near a front wall of the housing. A press-receiving portion is at the rear end of the movable arm and can be pressed by the pressing portion.

The movable member preferably is a lever that can be rotated from an initial position where the lever projects back from the rear end of the housing by a relatively long distance to a connection ending position where the lever projects by a relatively short distance. The lever includes a locking piece that is resiliently deformable along the thickness direction of the lever. The locking piece is displaced by moving onto a lock projection formed in the mating housing during a connecting operation. However, the locking piece moves over the lock projection and is restored when the housings are connected properly. The pressing portion preferably is on a surface of the locking piece facing the movable arm, and a press-receiving portion at the rear end of the movable arm is pressed by the pressing portion.

Accordingly, the pressing portion on the locking piece indirectly presses the detecting terminal via the movable arm and holds the detecting terminal separated from the contact terminal. The locking piece moves over the lock projection and is restored when the housings are connected properly. The detecting terminal also is restored resiliently and electrically contacts the contact terminal to close the detecting circuit when the pressing portion stops pressing the detecting terminal.

Movement of the movable member will cause the pressing portion to contact the press-receiving portion of the movable arm from behind, and the movable arm will incline about the front wall of the housing. Thus, even if the pressing portion is at the rear side of the housing, the movable arm will incline by an amount corresponding to the resilient deformation of the pressing portion and will contact the detecting terminal at the front side of the housing. Therefore the resiliently deformed state of the detecting terminal can be held precisely during the movement of the movable member.

The movable member preferably has at least one posture correcting arm arranged rotatably and substantially concentrically with a cam plate of the movable member and on a surface of the housing opposite the cam plate with respect to the height direction of the housing. An operation arm preferably connects the posture correcting arm and the cam plate to rotate the movable member. The posture correcting arm may further have at least one hook to engage a receiving portion in the mating housing for producing forces that pull the housings toward each other during the connecting operation.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A first embodiment of the invention is described with reference to FIGS. 1 to 26. A connector shown in this embodiment is an airbag connector and has male and female housings 80, 10 connectable with each other along a connecting direction CD. In the following description, reference is made to FIG. 1 concerning the vertical direction and ends of the housings 10, 80 that are to be connected are referred to as the fronts concerning forward and backward directions FBD.

Figure 1:
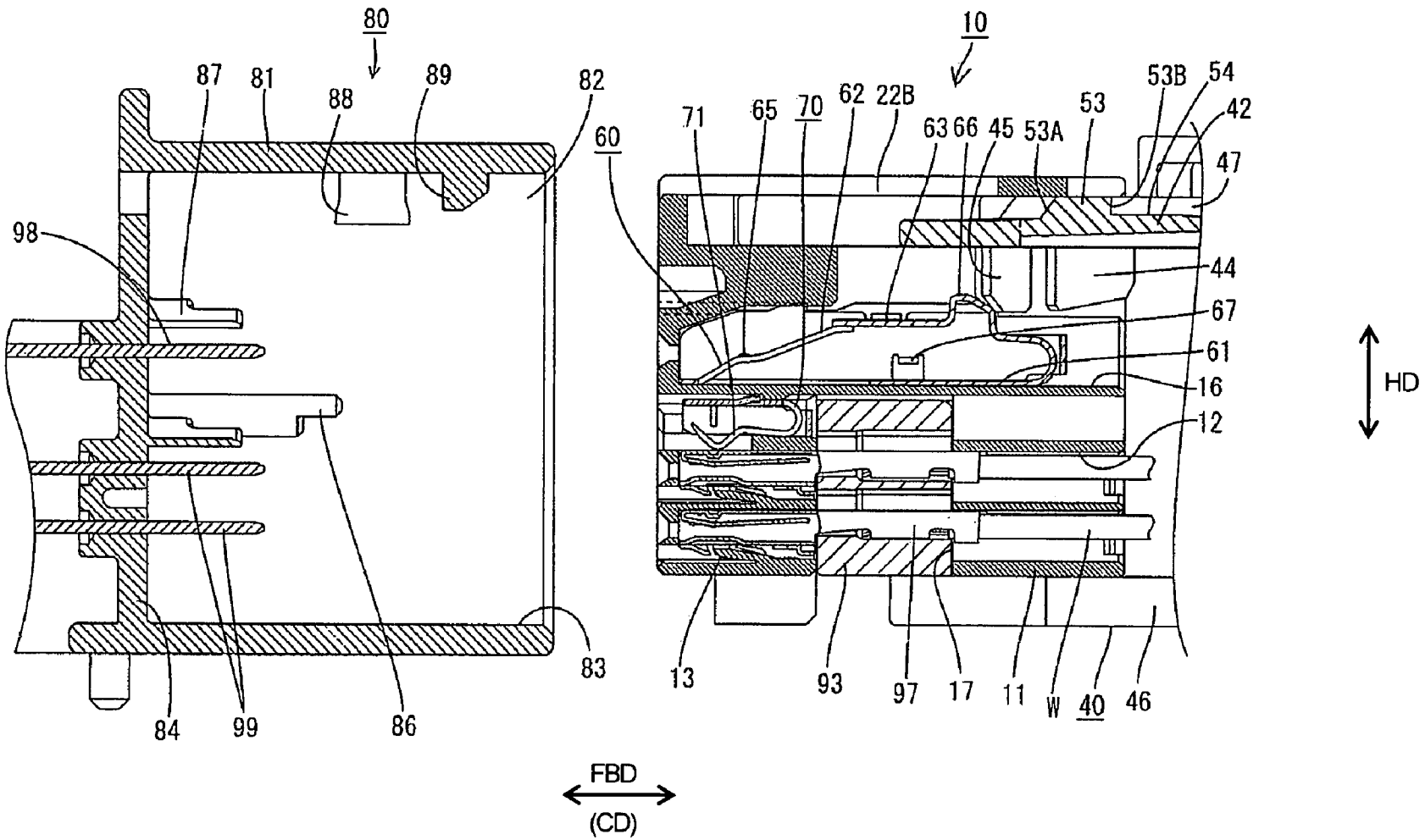
FIG. 1 is a side view in section of both male and female housings before being connected in one embodiment.
Figure 17:
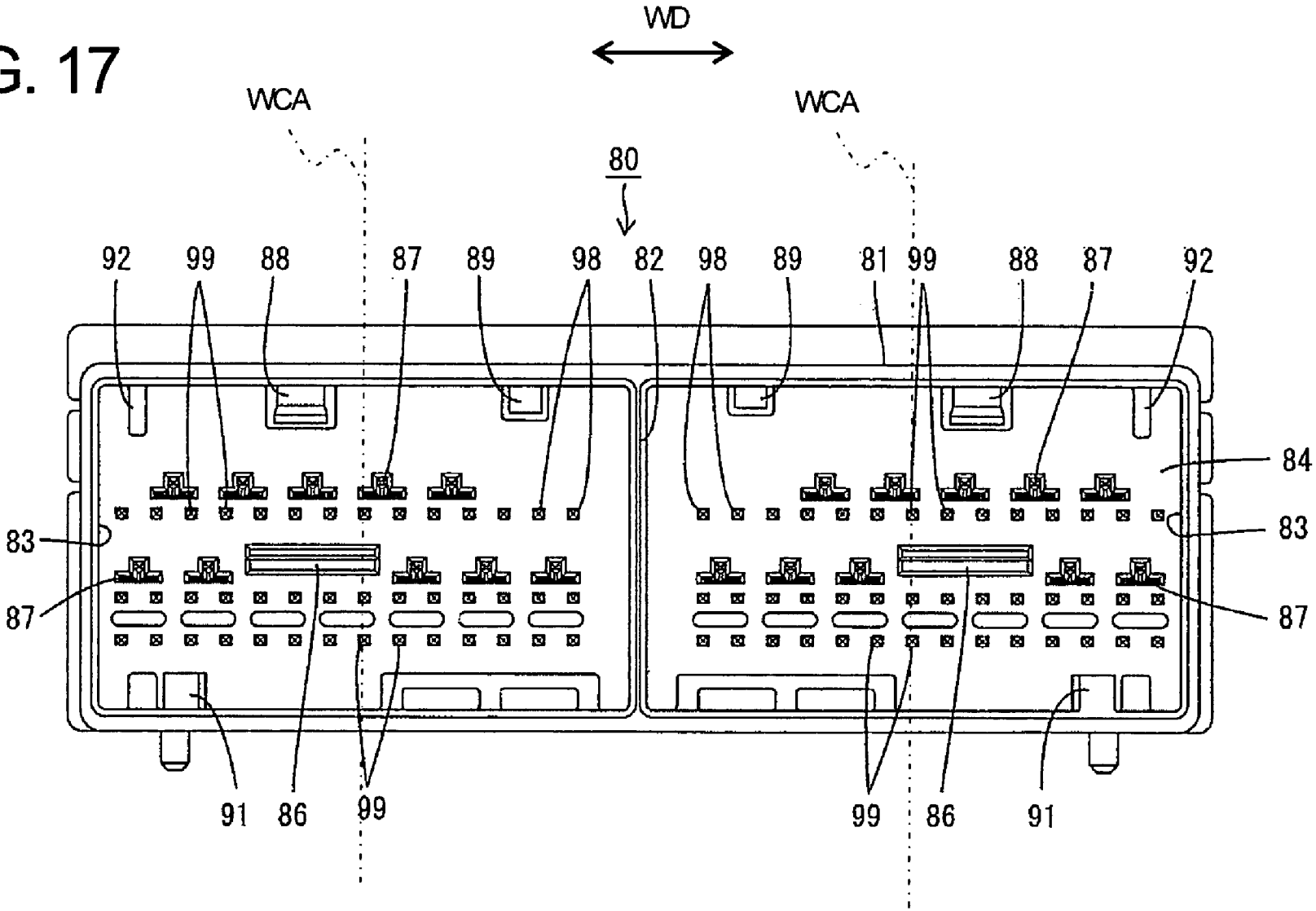
FIG. 17 is a front view of the male housing.

The male housing 80 is made e.g. of a synthetic resin and has a wide rectangular receptacle 81 that opens to the front, as shown in FIGS. 1 and 17. A partition wall 82 extends vertically in the height direction HD substantially along the widthwise center of the inner surface of the receptacle 81, and fitting recesses 83 are formed at the opposite left and right sides of the partition wall 82 for receiving the female housings 10. The fitting recesses 83 are substantially identical and are transversely symmetrical with respect to the partition wall 82.

Tab-shaped male terminal fittings 99 are passed through a back wall 84 of the male housing 80 and project into the receptacle 81. A portion of each male terminal fitting 99 that projects rearward from the back wall 84 is bent down substantially at right angle at an intermediate position and the bottom end thereof is connected electrically with a conductor path of an electric or electronic device, such as an unillustrated printed circuit board, junction box or electric appliance. Left and right protection walls 85 project back at the rear ends of the opposite side walls of the receptacle 81 to protect exposed portions of the male terminal fittings 99 from the outer lateral sides.

Projecting pieces 86 project from the back wall 84 and into the receptacle 81 at positions displaced from the widthwise central axes WCA of the respective fitting recesses 83. The projecting pieces 86 prevent the housings 10, 80 from being assembled erroneously. Short canceling pieces 87 project from the back wall 84 of the male housing 80 and into the receptacle 81 for canceling shorted states of shorting terminals 70 in the female housing 10 as the housings 10, 80 are connected.

Two contact terminals 98 arranged on one side of a group of the male terminal fittings 99 located at an upper stage and above the male terminal fittings 99 in two lower stages. The contact terminals 98 have substantially the same shape as the male terminal fittings 99 at the upper stage and the front ends of the contact terminals 98 substantially align with the front ends of the male terminal fittings 99 in each fitting recess 83. The contact terminals 98 are to be connected electrically with a detecting terminal 60 in the female housing 10 as the housings 10, 80 are connected properly, thereby constructing part of a detecting circuit.

Cam pins 88 project at positions displaced transversely out from the widthwise central axes WCA of the respective fitting recesses 83 and are engageable with cam grooves 41 of levers 40 assembled with the female connector housings 10. Lock projections 89 project at positions displaced towards the partition wall 82 from the widthwise central axes WCA of the respective fitting recesses 83 and are resiliently engageable with locking pieces 42 of the levers 40.

Receiving portions 91 project near the front of the bottom wall of the receptacle 81 at positions displaced transversely out from the widthwise central axes WCA of the respective fitting recesses 83. The receiving portions 91 are engageable with hooks 43 of the levers 40 to correct the postures of the housings 10, 80 during connection. Disengaging projections 92 project from the inner surface of the upper wall of the receptacle 81 at positions displaced transversely out from the widthwise central axes WCA of the respective fitting recesses 83. The disengaging projections 92 are substantially vertical plates that extend in forward and backward directions FBD.

Figure 18:
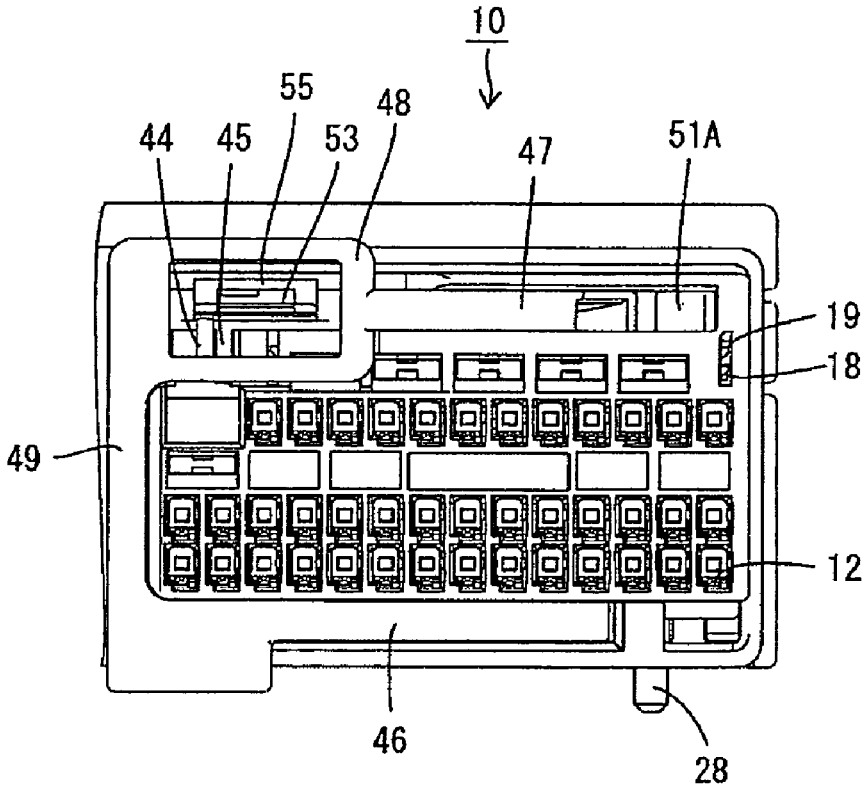
FIG. 18 is a rear view of the female housing.

Two female housings 10 made e.g. of a synthetic resin are prepared in correspondence with the fitting recesses 83. Each female housing 10 has a housing main body 11, a retainer 93 and the lever 40, as shown in FIGS. 1 and 18. The illustrated female housing 10 is accommodated in one fitting recess 83 of the male housing 80 and is substantially transversely symmetrical with respect to the one accommodated in the other fitting recess 83.

Figure 19:
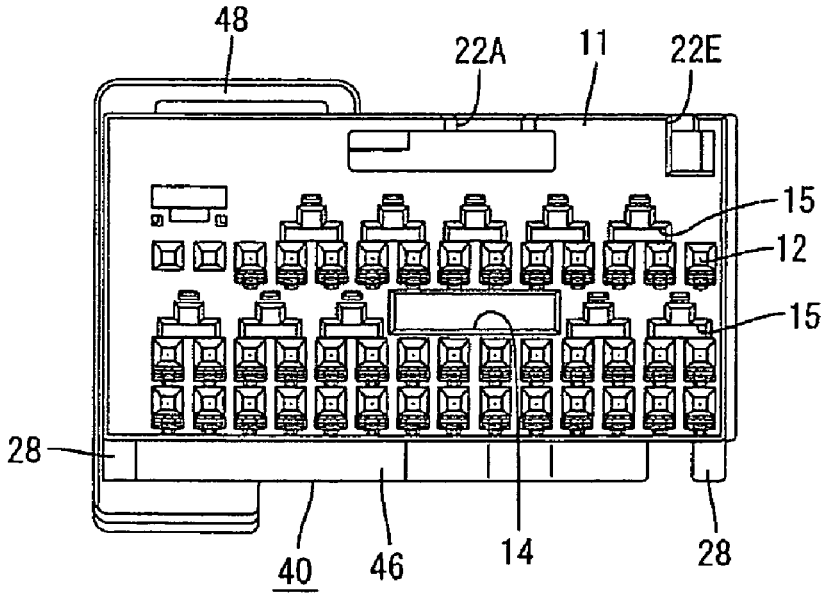
FIG. 19 is a front view of the female housing.
Figure 21:
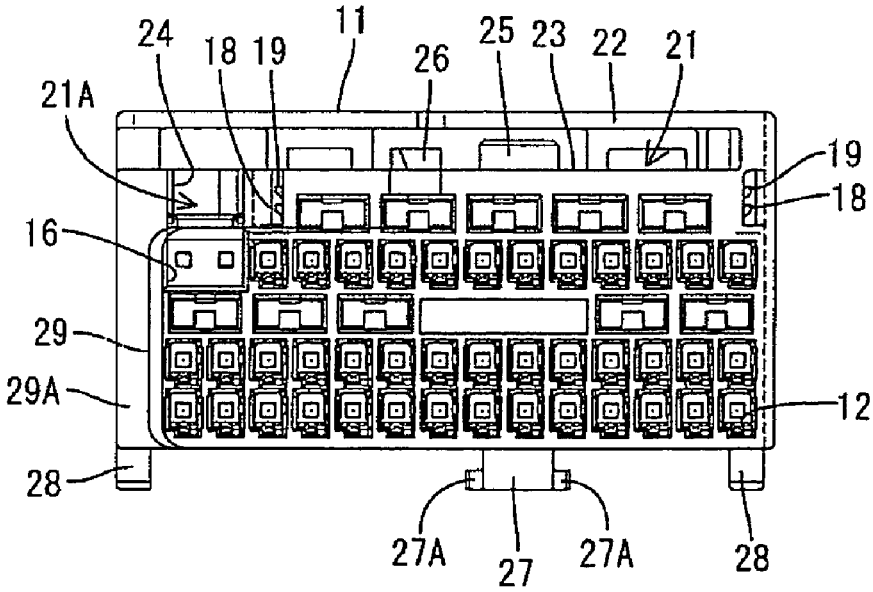
FIG. 21 is a rear view of the housing main body.

The housing main body 11 is substantially block-shaped and cavities 12 extend through the housing main body 11 in forward and backward directions FBD at positions corresponding to the mating male terminal fittings 99, as shown in FIGS. 19 and 21. A female terminal fitting 97 connected with an end of a wire W is inserted into each cavity 12 from behind, and is locked at a proper insertion position by a locking projection 13 that projects at the inner surface of the cavity 12.

A projecting-piece receiving recess 14 is formed in the front surface of the housing main body 11 for receiving the projecting piece 86 of the male connector housing 80 during connection of the housings 10, 80. Insertion of the projecting piece 86 into the projecting-piece receiving recess 14 prevents an upside-down connection of the housings 10, 80.

Figure 2:
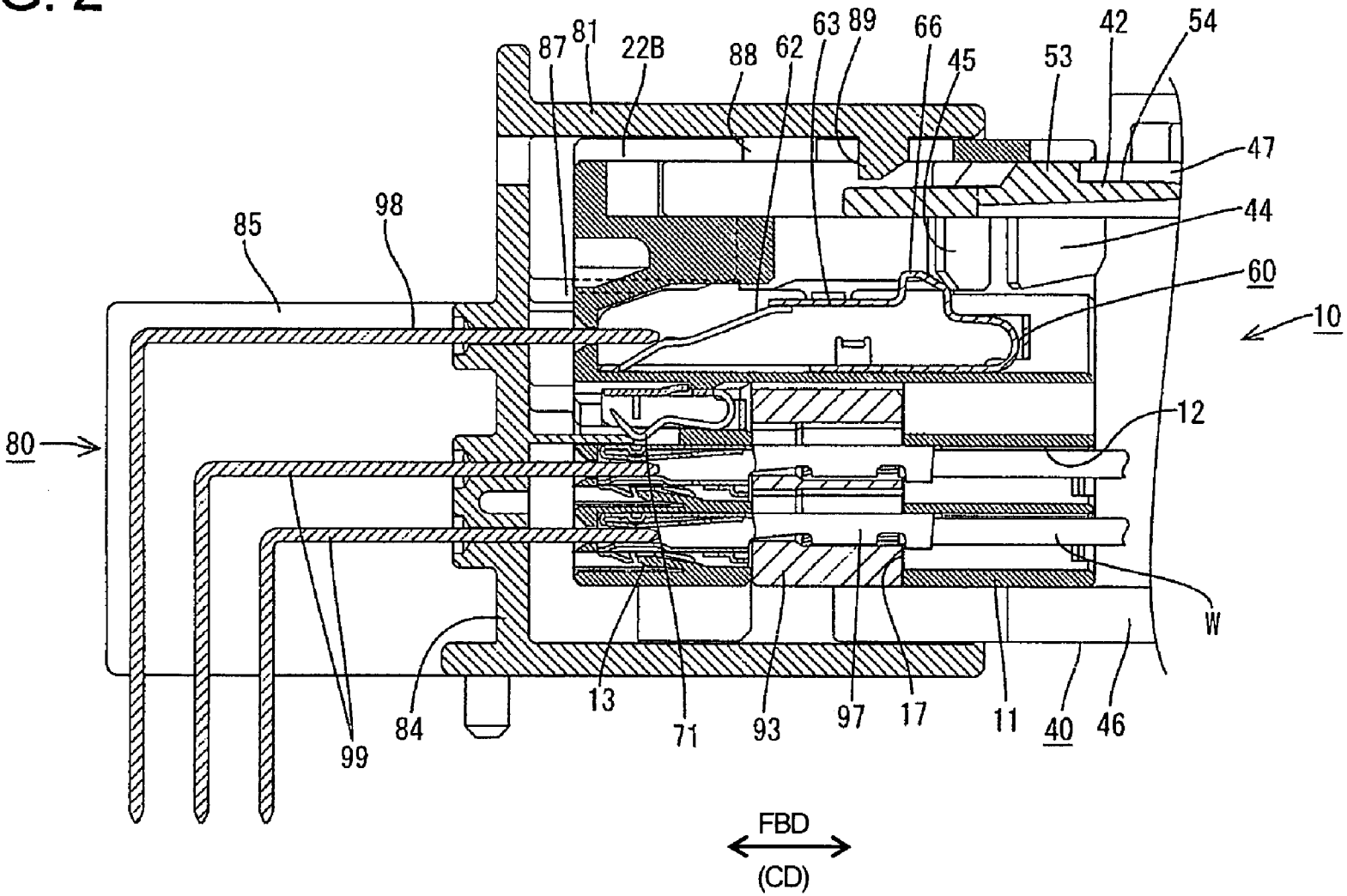
FIG. 2 is a side view in section of both housings immediately before a pre-pressing portion presses a pressable portion.

Shorting-terminal accommodating openings 15 are formed in the front surface of the housing main body 11 and communicate with the cavities 12 located therebelow. The shorting-terminal accommodating openings 15 accommodate shorting terminals 70. Each shorting terminal 70 includes at least two resilient pieces 71 for contacting at least two female terminal fittings 97 arranged substantially side by side in the cavities 12 located therebelow to short these female terminal fittings 97, as shown in FIG. 1. However, the short canceling pieces 87 of the male housing 80 deform the corresponding resilient pieces 71 of the shorting terminals 70 in a short-canceling direction to cancel the shorted state of pairs of the female terminal fittings 97 during a connecting operation of the housings 10, 80, as shown in FIG. 2.

A detecting-terminal accommodating space 16 is formed near one lateral side of the housing main body 11. The detecting-terminal accommodating space 16 is arranged substantially adjacent to and parallel to the upper level cavities 12 for the female terminal fittings 97, and the respective detecting terminals 60 can be inserted therein from behind.

Figure 25:
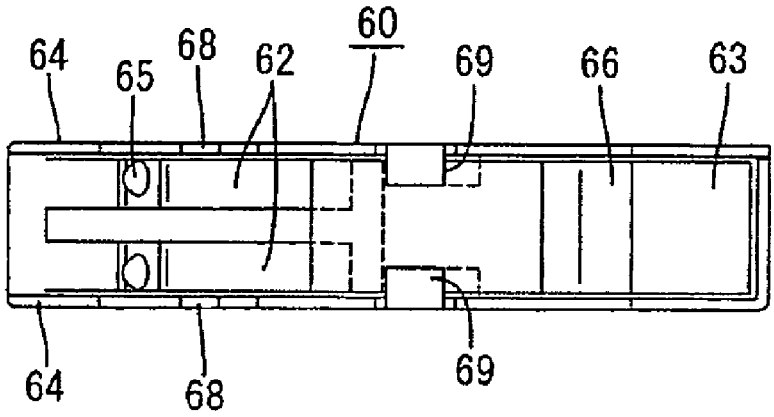
FIG. 25 is a plan view of the detecting terminal.
Figure 26:
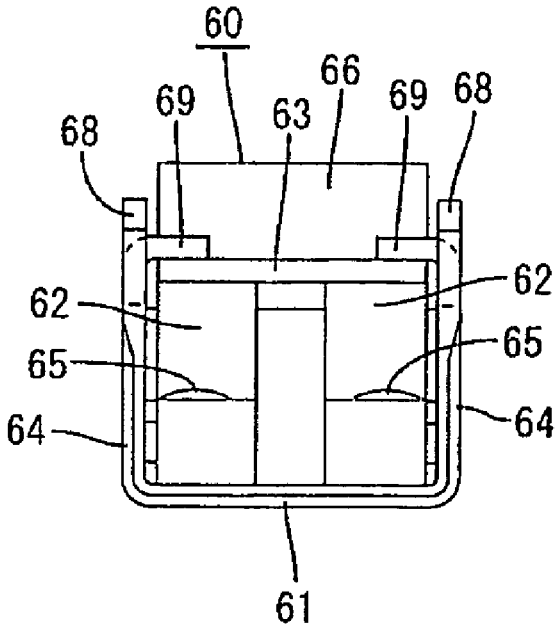
FIG. 26 is a front view of the detecting terminal.

The detecting terminal 60 is formed by bending an electrically conductive metal plate to define a base plate 61 to be arranged substantially along the inner surface of the detecting-terminal accommodating space 16. Two first springs 62 extend obliquely back and up from the front end of the base plate 61. A second spring 63 extends obliquely forward and up from the rear end of the base plate 61, and opposite side walls 64 stand up along opposite side edges of the base plate 61 as shown in FIGS. 1, 25 and 26. The first springs 62 are arranged side by side in the width direction on the base plate 61, and are formed by making a cutout in the base plate 61 to leave a substantially U-shaped piece and bending the lateral projecting pieces. Contacts 65 project at positions near the base ends of the first springs 62 for contacting the contact terminals 98. Accordingly, both first springs 62 connect with the corresponding contact terminals 98, and individually deform to avoid a situation where the first springs 62 are brought out of alignment with the corresponding contact terminals 98. On the other hand, the second spring 63 is formed by folding a rear part of the base plate 61 forward, and the front end of the second spring 63 is arranged to cover the rear ends of both first springs 62 from above.

An upward-projecting pressable portion 66 is formed at an intermediate position of the second spring 63. Specifically, the pressable portion 66 extends substantially vertically at the base end of the second spring 63 and then slants obliquely up and out towards the front. The pressable portion 66 then extends a short distance horizontally from the front end of the slant and then substantially vertically down. By rotating the lever 40, the pressing portion 44 and the pre-pressing portion 45 of the lever 40 slide in contact with the pressable portion 60 while making an arcuate movement along a rotational path of the lever 40, thereby resiliently deforming the pressing portion 66 down in a deforming direction. As the pressable portion 66 is displaced, the first springs 62 also are deformed resiliently down in the deforming direction.

Left and right excessive deformation preventing pieces 67 are formed by making cuts in the opposite side walls 64 and bending the cut portions in to prevent excessive deformation of the second spring 63. Left and right lock projections 68 are formed at the upper ends of the opposite side walls 64 and are engageable with the inner surfaces of the detecting-terminal accommodating portion 16. Left and right spring pressing pieces 69 are bent in at the upper ends of the opposite side walls 64 for pressing the opposite side edges of the second spring 63 from above. The second spring 63 is pressed while being loaded beforehand to press both spring pressing pieces 69 up. Therefore it is not necessary to adjust a spring reaction force.

Figure 11:
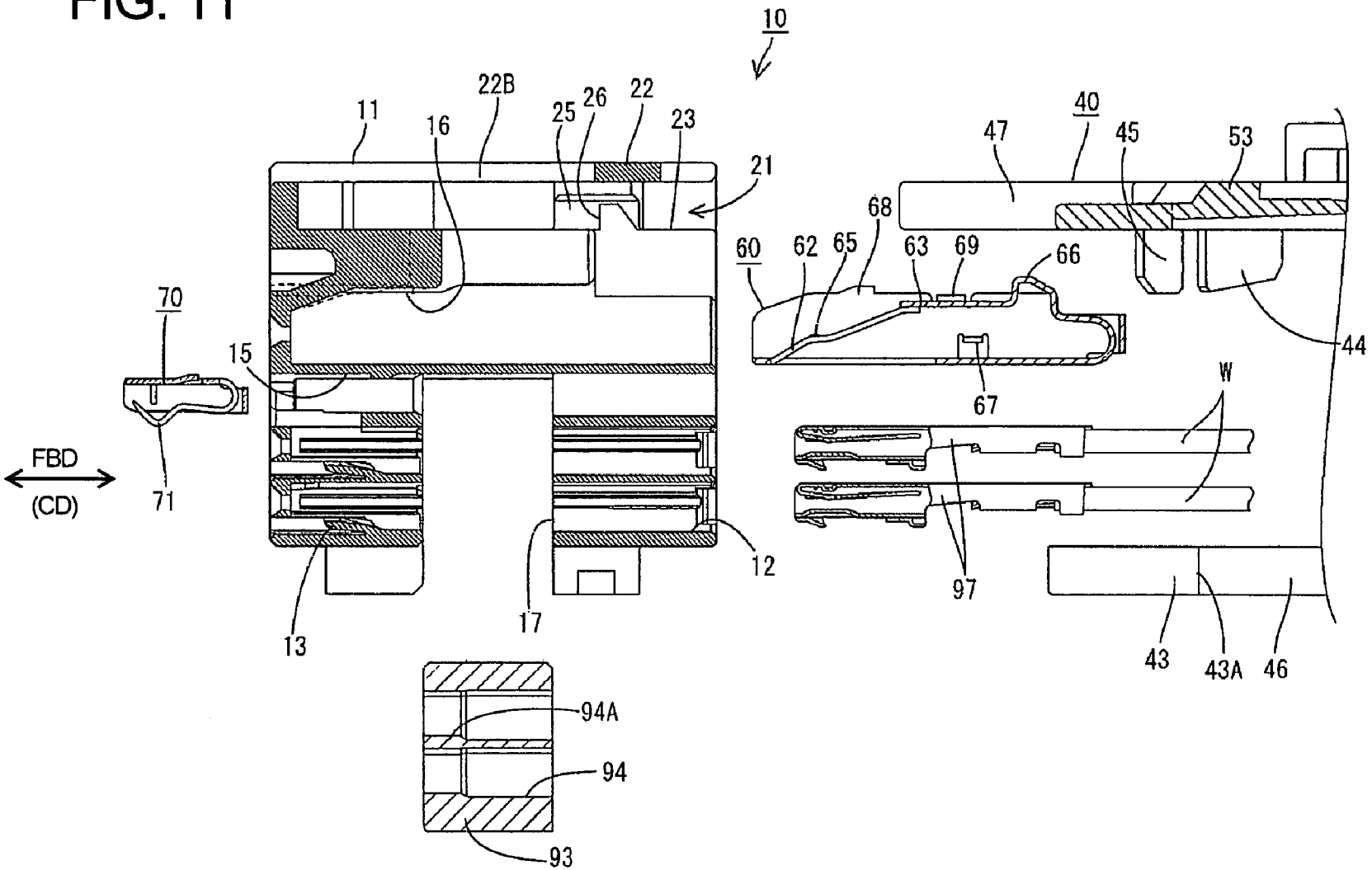
FIG. 11 is an exploded side view in section of the female housing.

As shown in FIG. 11, the housing main body 11 is formed with a retainer mount hole 17 extending over the bottom surface and the opposite side surfaces of the housing main body 11. The retainer mount hole 17 has a depth to cross and communicate with the cavities 12 at the three stages. Partial locking projections 18 and full locking projections 19 are formed one above the other on the opposite side surfaces at an upper part of the retainer mount hole 17 in the housing main body 11, as shown in FIG. 21, for holding the retainer 93 at a partial locking position and a full locking position.

Figure 23:
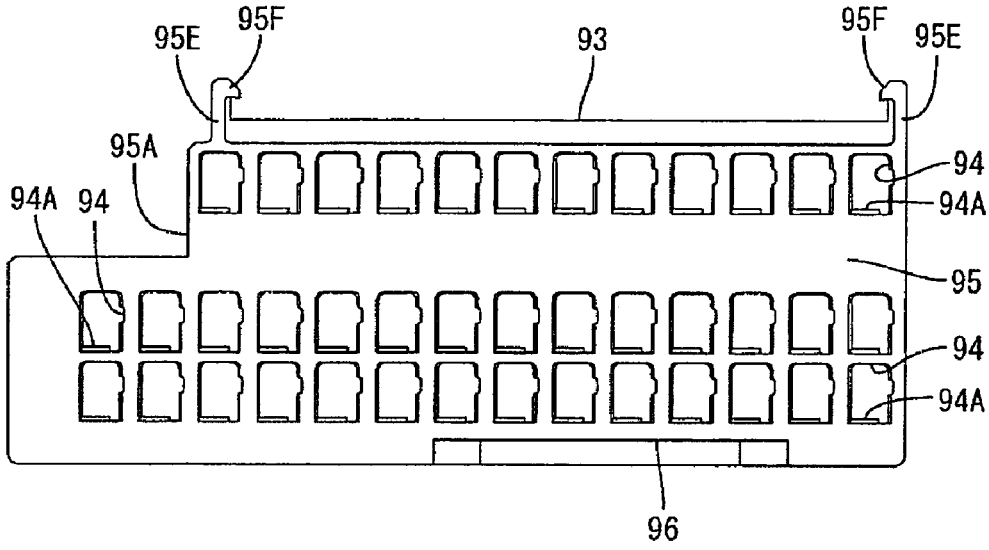
FIG. 23 is a rear view of the retainer.

As shown in FIG. 23, the retainer 93 includes a main frame 95 with windows 94 that communicate with the cavities 12. Latching projections 94A are formed on the inner surfaces of the windows 94 for latching the female terminal fittings 97. A step 95A is formed by cutting off at least one of the four corners of the main frame 95. The surrounding wall of the detecting-terminal accommodating space 16 is fit at the inner side of the step 95A. Left and right resiliently deformable locking arms 95E project up at the opposite lateral ends excluding the step 95A of the main frame 95 and a locking claw 95F projects in at the leading end of each locking arm 95E.

Figure 15:
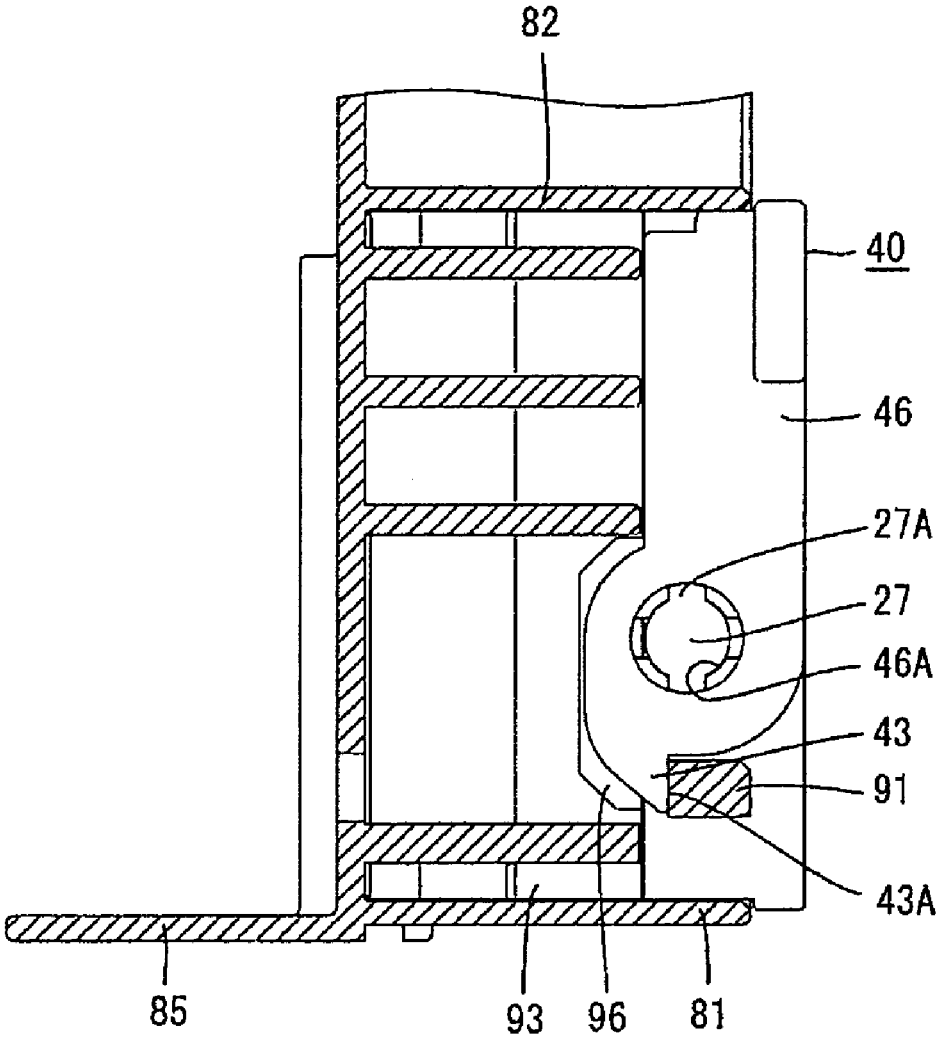
FIG. 15 is a horizontal section of both housings properly connected by the engagement of a hook of the lever with a receiving portion.
Figure 22:
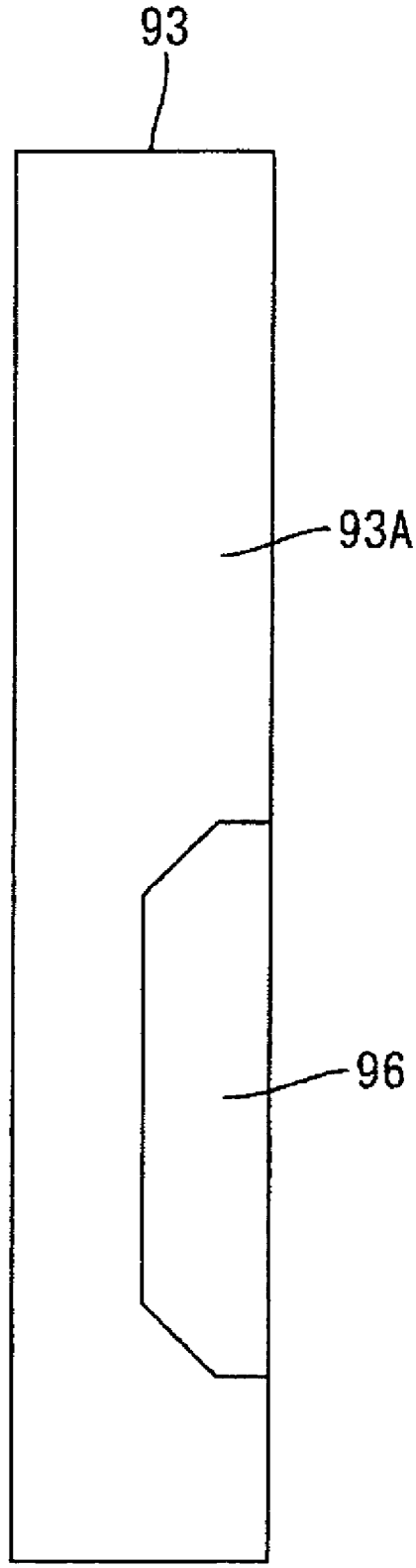
FIG. 22 is a bottom view of a retainer.

The retainer 93 is movable between the partial and full locking positions in the retainer mount hole 17. More particularly, the bottom of the retainer projects from the bottom surface of the housing main body 11 and the locking claws 95F of the locking arms 95E engage the partial locking projections 18 when the retainer 93 is at the partial locking position. On the other hand, the bottom of the retainer 93 is substantially flush with the bottom surface of the housing main body 11 and the locking claws 95F of the locking arms 95E engage the full locking projections 19 when the retainer 93 is pressed deeper to the full locking position. The latching projections 94A are at lateral sides of the cavities 12 when the retainer 93 is at the partial locking position to permit insertion and withdrawal of the female terminal fittings 97. However, the latching projections 94A enter the cavities 12 and cooperate with the locks 13 to retain the properly inserted female terminal fittings 97 in the cavities 12 when the retainer 93 is at the full locking position. Further, as shown in FIGS. 15 and 22, an escaping recess 96 is formed in the bottom press-in surface 93A of the retainer 93 for avoiding interference with a posture correcting arm 46 of the lever 40. A bottom part of the posture correcting arm 46 fits in the escaping recess 96 when the retainer 93 at the partial locking position.

As shown in FIG. 21, a rearwardly open accommodating space 21 is formed at an upper part of the housing main body 11 for accommodating the lever 40. The accommodating space 21 is defined between a thin covering wall 22 located at the outermost position and a lever mounting surface 23 opposed thereto. The lever 40 is mounted by being slid in a substantially horizontal posture into the accommodating space 21 from behind. The detecting-terminal accommodating portion 16 communicates with the accommodating space 21 via a through hole 24 penetrating the lever mounting surface 23.

A substantially cylindrical supporting shaft 25 projects from the lever mounting surface 23 for rotatably supporting the lever 40. A cam plate 47 of the lever 40 moves over the supporting shaft 25 and resiliently deforms the covering wall 22 in the process of mounting the lever 40. Therefore, the supporting shaft 25 is fit into a bearing 47A of the cam plate 47 to retain the lever 40 in the accommodating space 21 when the lever 40 reaches a proper mount position. The supporting shaft 25 is displaced from the widthwise central axis of the housing main body 11 and a central axis of the housing main body 11 with respect to forward and backward directions FBD. A cam-plate engaging portion 26 projects at a position adjacent to the supporting shaft 25 on the lever mounting surface 23, and is engageable with an engaging recess 47B in the cam plate 47 to hold the lever 40 at a connection starting position CSP and a connection ending position CEP.

A supporting shaft 27 projects from the bottom surface 11BS of the housing main body 11 on the same vertical axis as the supporting shaft 25. The supporting shaft 27 engages a bearing 46A of the posture correcting arm 46 of the lever 40 and cooperates with the supporting shaft to support the lever 40 at two positions. Retaining projections 27A project in substantially opposite directions at the leading end of the supporting shaft 27 so that the posture correcting arm 46 does not come off the supporting shaft 27 during rotation of the lever 40. Left and right adjusting projections 28 are formed at opposite widthwise ends of the bottom surface 11BS of the housing main body 11 at a sides of the retainer mount hole 17 substantially opposite to the supporting shaft 27 with respect to forward and backward directions FBD. The adjusting projections 28 project substantially the same distance as the supporting shaft 27 so that the leading ends thereof align with the leading end of the supporting shaft 27 to prevent the female housing 10 from being connected while leaning forward in the process of connecting the housings 10, 80.

Figure 20:
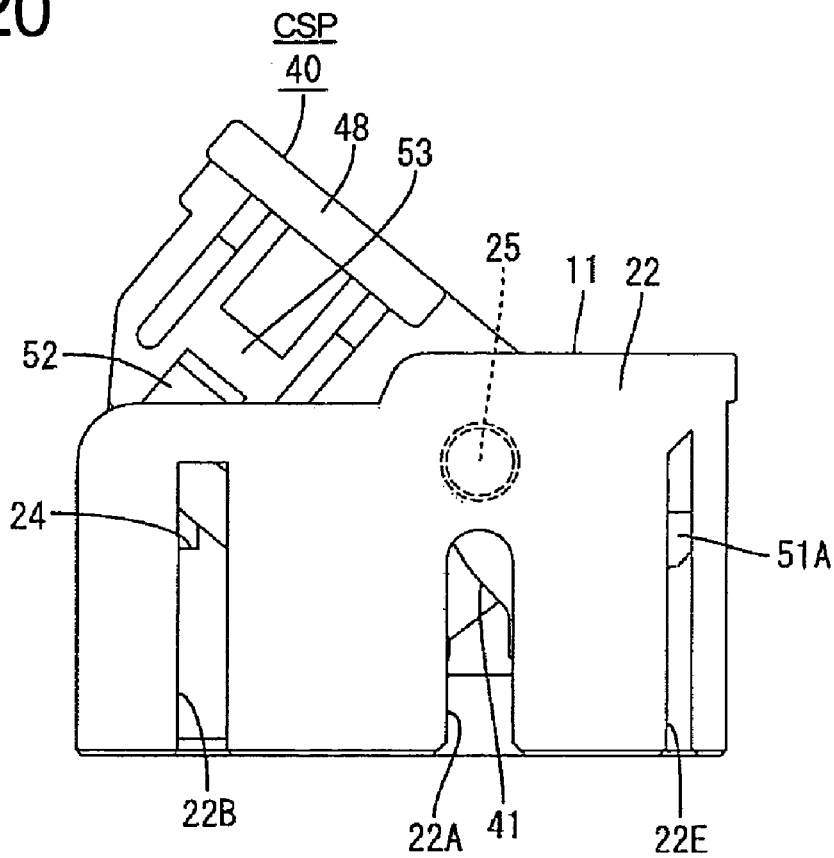
FIG. 20 is a plan view of the female housing when the lever is at a connection starting position.

As shown in FIG. 20, a cam-pin introducing groove 22A is formed in the covering wall 22 immediately before the supporting shaft 25 with respect to forward and backward directions FBD. The cam-pin introducing groove 22A extends in forward and backward directions FBD and opens at the front end for receiving a cam pin 88 of the male housing 80. The cam pin 88 is introduced while being held in sliding contact with the lateral edges of the cam-pin introducing groove 22A. A guide groove 22B is formed in the covering wall 22 at a position displaced toward a side opposite to the cam-pin introducing groove 22A. The guide groove 22B extends in forward and backward directions FBD and opens at the front end for receiving the lock projection 89 of the male housing 80. The lock projection 89 is introduced while being held in sliding contact with the opposite lateral edges of the guide groove 22B. Further, a guiding groove 22E is formed in the covering wall 22 for receiving the disengaging projection 92 of the male housing 80 while being held in sliding contact substantially in parallel with the guide grooves 22B and the cam-pin introducing groove 22A at a side opposite to the guide groove 22B.

Figure 7:
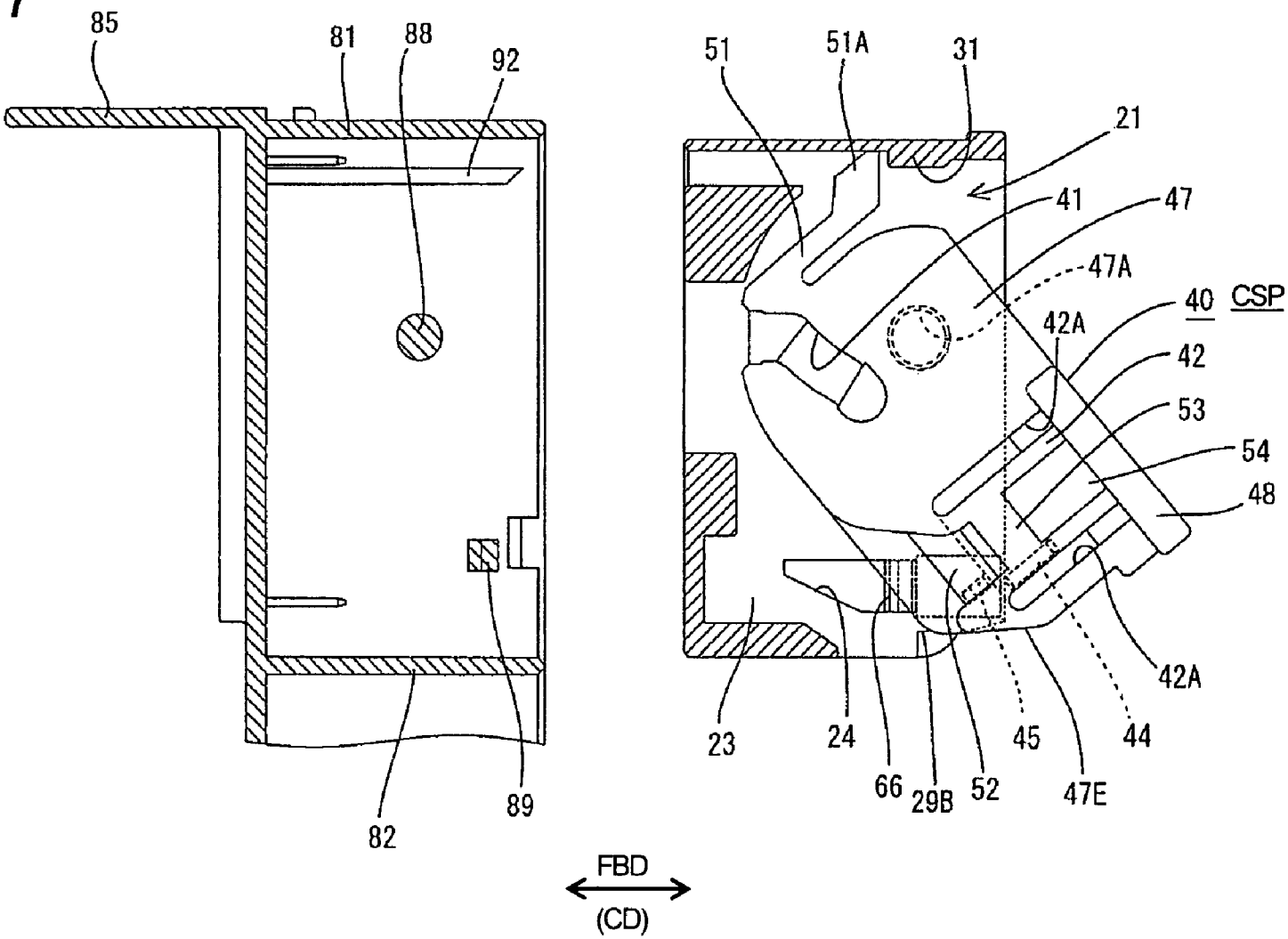
FIG. 7 is a horizontal section of both housings before connection.

The lever mounting surface 23 and the covering wall 22 are cut to expose part of one side of the accommodating space 21 at the rear of the housing main body 11. A protecting-portion accommodating space 21A is defined in an exposed part of the accommodating space 21A and accommodates a rectangular frame-shaped protecting portion 48 of the lever 40. A step 29 is formed in one side surface of the housing main body 11, as shown in FIG. 21, and a stepped recess 29B is defined in an area before the step 29, as shown in FIG. 7. The stepped recess 29B is slightly lower than a rear area and extends substantially vertically to face the accommodating space 21. A contact surface 29A faces forwardly on the step 29 and can be pressed by an operation arm 49 of the lever 40 when the lever 40 is rotated to the connection ending position CEP.

Figure 10:
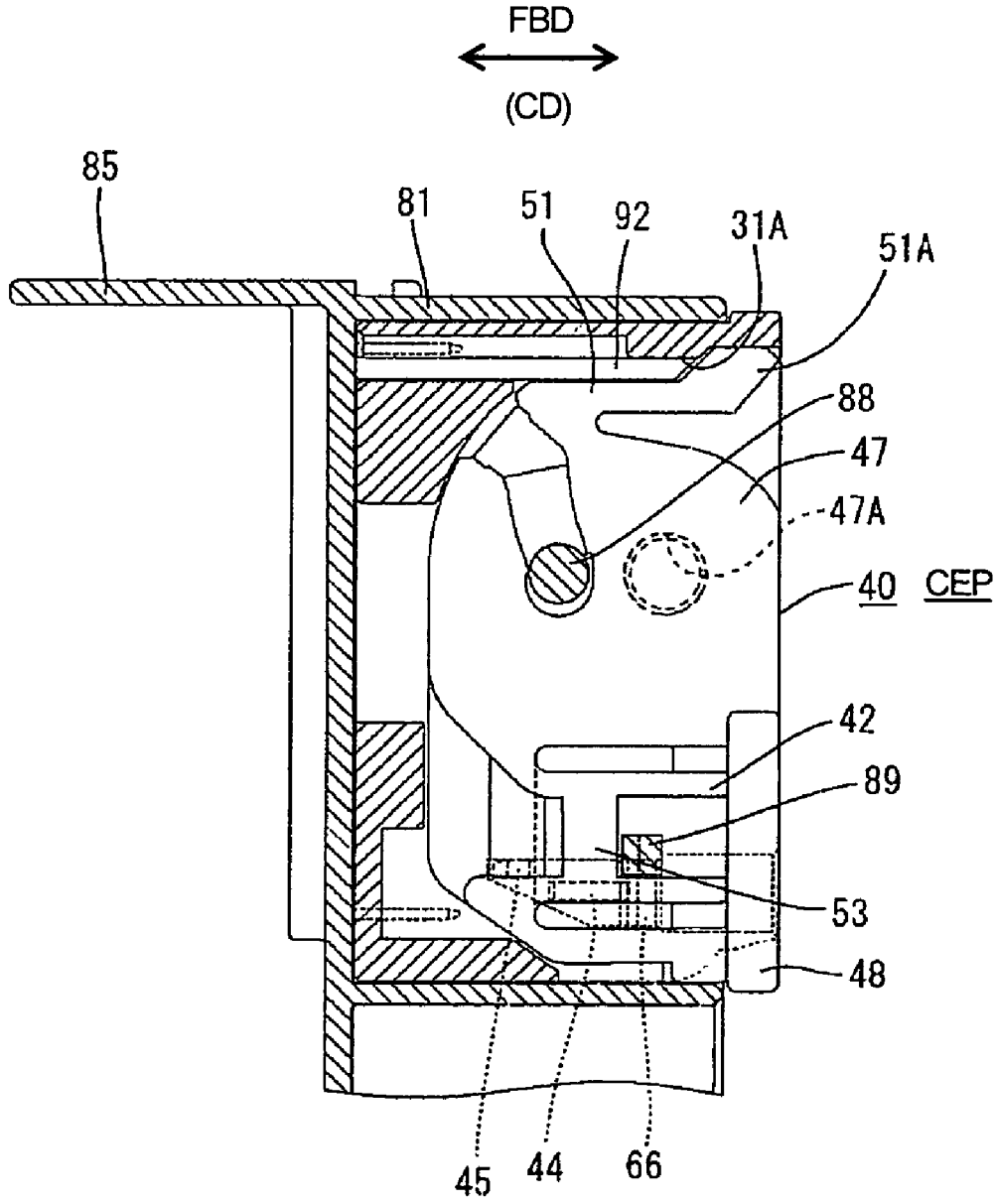
FIG. 10 is a horizontal section of both housings properly connected upon the arrival of the lever at the connection ending position.

As shown in FIG. 7, the lever 40 is comprised of a posture correcting arm 46, a cam plate 47 and an operation arm 49 that couples the ends of the cam plate 47 and the arm 46 so that the lever 40 is substantially U-shaped. A cam groove 41 is formed at a portion of the cam plate 47 distanced from the operation arm 49, and is engageable with the cam pin 88 of the male housing 80. Thus, the housings 10, 80 can be connected and separated by movements of the cam pin 88 along the cam groove 41. It should be noted that a cam groove 41 is not formed in the posture correcting arm 46. The state of the lever shown in FIG. 10 is referred to herein as the connection ending position CEP.

The lower surface of the cam plate 47 is cut at a position near the inner end of the cam groove 41 to form a substantially round bearing 47A. An engaging recess 47B is formed near the bearing 47A and defines an arc substantially concentric with the bearing 47A. The cam-plate engaging portion 26 slides in contact with the engaging recess 47B to guide the rotation of the lever 40.

A resiliently deformable temporary holding arm 51 is formed at the outer periphery of the cam plate 47 near the entry of the cam groove 41 and extends substantially in forward and backward directions FBD when the lever 40 is at the connection ending position CEP. A tip projection 51A of the temporary holding arm 51 engages a temporarily receiving portion 31 at a lateral edge of the accommodating space 21 of the housing main body 11 before the housings 10, 80 are connected to prevent rotation of the lever 40. The tip projection 51A is pushed by the disengaging projection 92 of the male housing 80 when a connecting operation of the housings 10, 80 is started, and is deformed resiliently in the unlocking direction so that the lever 40 can rotate.

A resiliently deformable locking piece 42 is formed by two slits 42A that open at the rear end of the cam plate 47 near the operation arm 49 and substantially opposite the cam groove 41 and the bearing 47A. Thus, the locking piece 42 can deform up and down about its front end so that the rear end of the locking piece 42 can engage the lock projection 89 of the male housing 80. The cam plate 47 has a slanted edge 47E that limits the forward extent of one of the slits 42A.

An escaping recess 52 is formed in an area of the upper surface of the cam plate 47 before the locking piece 42 for avoiding interference with the lock projection 89 and to enable rotation of the lever 40. A locking projection 53 is formed near the base end of the locking piece 42 and is substantially continuous with the rear end of the escaping recess 52. A slanted guiding surface 53A is formed at the front of the locking projection 53 and slopes up and out towards the back, as shown in FIG. 1. The upper surface of the locking projection 53 is substantially flat and coplanar with the general reference surface of the cam plate 47. A substantially vertical locking surface 53B is formed at the rear of the locking projection 53 and defines a step into a recess 54 behind the locking projection 53. The lock projection 89 moves along the guiding surface 53A of the locking projection 53 during rotation of the lever 40 and deforms the locking piece 42 down and in. The lock projection 89 slides in contact with the flat surface of the locking projection 53 and then fits into the recess 54 when the lever 40 reaches the connection ending position CEP. Thus, the lock projection 89 is locked by the locking surface 53B of the locking projection 53.

Figure 24:
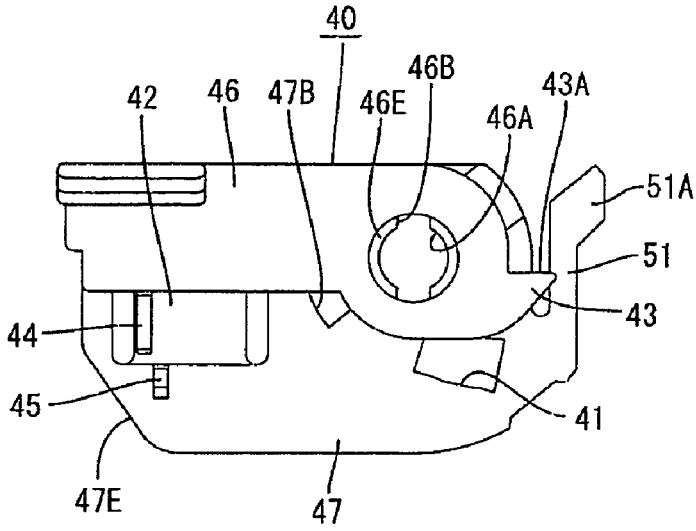
FIG. 24 is a side view of the lever when seen from a posture correcting arm.

As shown in FIGS. 1 and 24, a pressing portion 44 projects substantially along one lateral edge of the base end of the locking piece 42 on the lower surface of the cam plate 47. The locking projection 53 engages the lock projection 89 at a rotation position of the lever 40 before the connection ending position CEP and causes the locking piece 42 to deform down and in. As a result, the pressing portion 44 contacts the pressable portion 66 of the second spring 63 of the detecting terminal 60 from behind and deforms the second spring 63 down and in together with the first springs 62. The pressing portion 44 stops pressing the second spring 63 substantially when the lever 40 reaches the connection ending position CEP so that the first and second springs 62 and 63 restore resiliently. The front end of the pressing portion 44 is substantially vertical and the bottom end thereof is sloped up towards the back. The slant of the pressing portion 44 is substantially horizontally held when the locking piece 42 is deformed maximally.

A pre-pressing portion 45 projects on the inner surface of the cam plate 47 at a position before the locking piece 42 and displaced slightly inward in the width direction WD from the pressing portion 44. The pre-pressing portion 45 extends substantially parallel to the connecting direction CD, but is shorter in forward and backward directions FBD than the pressing portion 44. The pre-pressing portion 45 contacts the pressable portion 66 from behind to deform the first and second springs 62 and 63 before the pressing portion 44 presses the pressable portion 66 of the detecting terminal 60 during the rotation of the lever 40. The pre-pressing portion 45 moves over the pressable portion 66 as the lever 40 is rotated further, and the pressing portion 44 presses the pressable portion 66 of the second spring 63 when the pre-pressing portion 45 stops pressing the second spring 63. A bottom part of the front end of the pre-pressing portion 45 slopes down and in towards the back, and the bottom end thereof is substantially horizontal and flat. The pre-pressing portion 45 is in a range unaffected by the deformation of the locking piece 42 and is distanced from the pressing portion 44. Thus, the rear end of the pre-pressing portion 45 and the front end of the pressing portion 44 will not interfere while the locking piece 42 is deformed.

The contact terminals 98 enter the detecting terminal 60 as the lever 40 is rotated. However, the pre-pressing portion 45 and the pressing portion 44 successively press the first and second springs 62 and 63 to displace the contact portions 65 of the first springs 62 during the rotation of the lever 40. Thus, the contacts 65 of the first springs 62 do not to touch the contact terminal 98. On the other hand, the pressing portion 44 stops pressing the second spring 63 when the lever 40 reaches the connection ending position CEP. As a result, the first and second springs 62 and 63 resiliently restore to bring the contacts 65 of the first spring 62 into contact with the contact terminals 98, thereby closing a detecting circuit.

Figure 13:
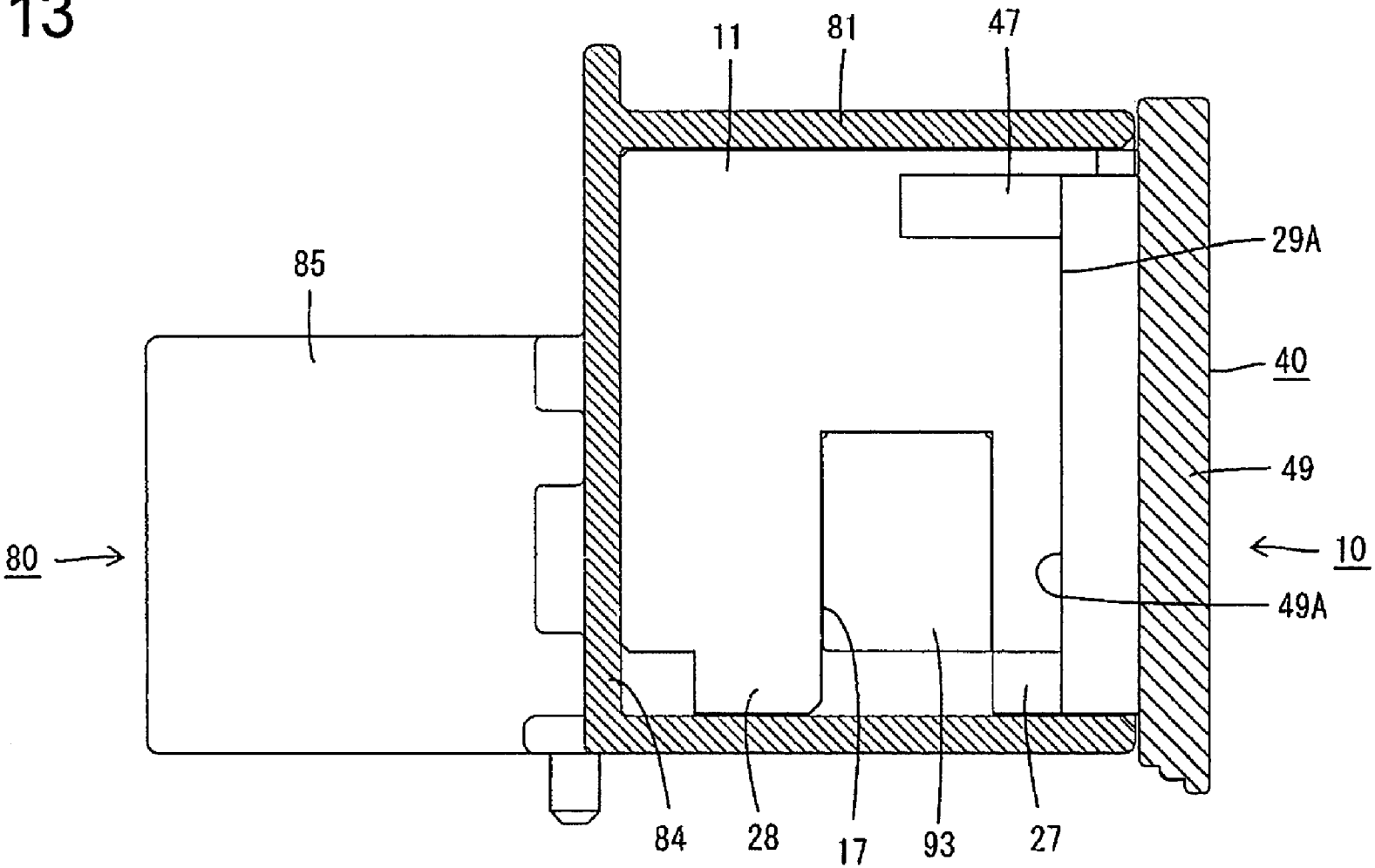
FIG. 13 is a side view in section of both housings properly connected by a pushing surface of the lever pushing a housing main body.

As shown in FIG. 13, the operation arm 49 of the lever 40 is a long plate extending substantially in the height direction HD and substantially normal to the forward and backward directions FBD. The operation arm 49 fits into the stepped recess 29B of the housing main body 11 and a pushing surface 49A at the front end of operation arm 49 is pressed against the contact surface 29A of the housing main body 11 when the lever 40 reaches the connection ending position CEP. The pushing surface 49A of the operation arm 49 presses the contact surface 29A forward in a connecting direction CD to prevent the housings 10, 80 from being connected in inclined postures.

As shown in FIG. 24, the posture correcting arm 46 of the lever 40 substantially faces the cam plate 47 with the housing main body 11 located therebetween, and is narrower than the cam plate 47 to avoid interference with the retainer 93. The bearing 46A penetrates the posture correcting arm 46 in the thickness direction at a position coaxial with the bearing 47A of the cam plate 47 with respect to the vertical direction. Escaping grooves 46B and engaging edges 46E are formed at the inner edge of the bearing 46A of the posture correcting arm 46. The escaping grooves 46B receive the retaining projections 27A and the engaging edges 46E receive the retaining projections 27A substantially in a detaching direction of the lever 40.

A hook 43 is formed at the leading end of the posture correcting arm 46 and has a hooking surface 43A that extends substantially normal to a rotating direction of the lever 40. The hook 43 engages the receiving portion 91 of the male housing 80 with the hooking surface 43A opposed to the rear surface of the receiving portion 91 immediately before the lever 40 reaches the connection ending position CEP if the housings 10, 80 are connected while being inclined from their proper postures with respect to the width direction WD. Further, the hook 43 pulls the receiving portion 91 as the lever 40 is rotated to the connection ending position CEP and corrects the postures of the housings 10, 80.

Figure 16:
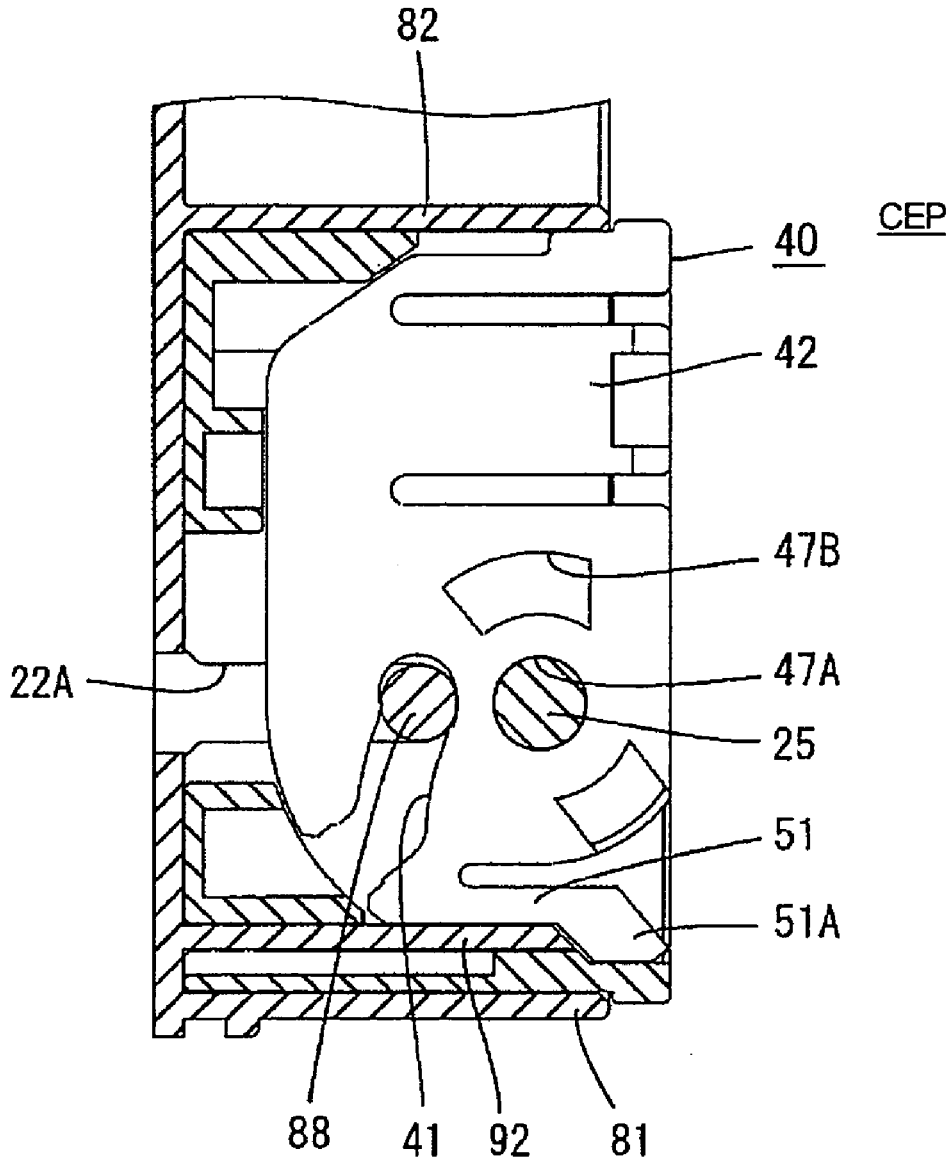
FIG. 16 is a horizontal section of both housings properly connected by the engagement of the cam pin and the cam groove.

The operation arm 49 of the lever 40 projects from the rear surface of the housing main body 11 at the connection starting position CSP, as shown in FIGS. 7 and 20. However, the rear end surface of the lever 40 is substantially flush with the rear surface of the housing main body 11 with no step to the rear end of the housing main body 11 at the connection ending position CEP, as shown in FIGS. 10 and 16. Accordingly, whether the housings 10, 80 have been connected properly can be judged by confirming whether the rear end surfaces of the lever 40 and the housing main body 11 are substantially flush with each other.

The male housing 80 is fixed to the electric or electronic device, such as a circuit board, while establishing electrical connection between the male terminal fittings 99 and conductor paths of the electric or electronic device, and is kept on standby until the start of the connecting operation with the female housing 10.

The retainer 93 is inserted into the retainer mount hole 17 of the female housing 10 and is held at the partial locking position. The cam plate 47 of the lever 40 then is slid into the accommodating space 21 of the housing main body 11 so that the bearing 47A of the cam plate 47 engages the supporting shaft 25 and so that the bearing 46A of the posture correcting arm 46 engages the supporting shaft 27 at the opposite side. Thus, the lever 40 is mounted in the housing main body 11 and is at the connection ending position CEP. At this time, the posture correcting arm 46 of the lever 40 and the retainer 93 overlap in the thickness direction. However, the posture correcting arm 46 is in the escaping recess 96 of the retainer 93 to avoid mutual interference.

The female housing 10 is transported to an assembling site and an operator or machine inserts the female terminal fittings 97 into the cavities 12 of the housing main body 11 from behind. The female terminal fittings 97 can be inserted smoothly because there is no step between the rear ends of the lever 40 and the housing main body 11. The shorting terminals 70 and the detecting terminal 60 also may be assembled into the housing main body 11 at this time. The retainer 93 then is pushed to the full locking position and cooperates with the locks 13 to redundantly lock the properly inserted female terminal fittings 97. The lever 40 now can be rotated because the retainer 93 at the full locking position does not project out of the housing main body 11.

Figure 8:
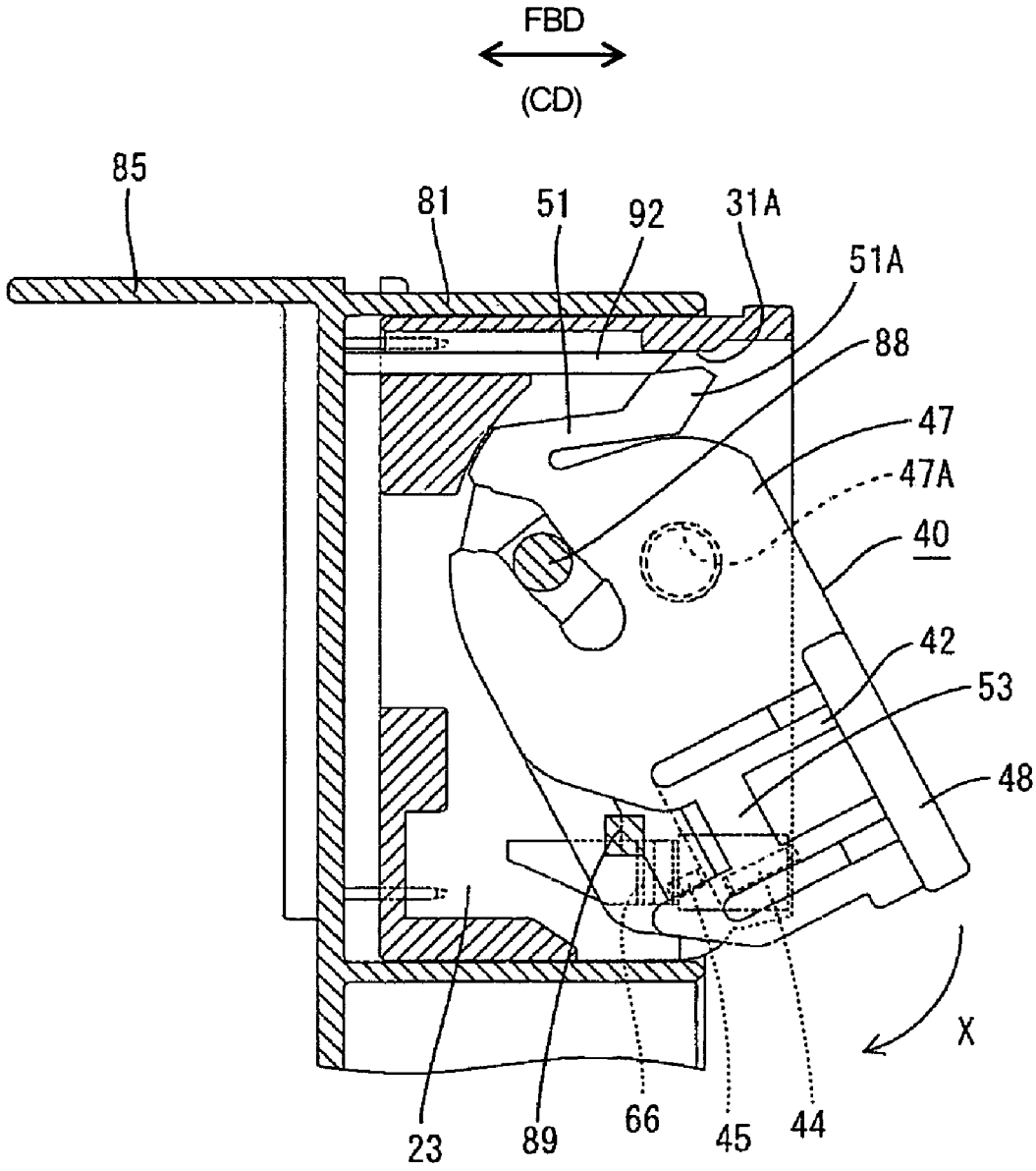
FIG. 8 is a horizontal section of both housings immediately before a connecting operation is started.

Subsequently, the lever 40 is rotated to the connection starting position CSP, as shown in FIGS. 7 and 20. As a result, the tip projection 51A of the temporary holding arm 51 engages the temporarily receiving portion 31 of the housing main body 11. Additionally, the entrance of the cam groove 41 aligns vertically with the entrance of cam-pin introducing groove 22A. The female housings 10 then are fit lightly into the fitting recesses 83 of the receptacle 81 of the male housing 80 and are held in the standby state. Thus, as shown in FIG. 8, each disengaging projection 92 moves between and separates the temporary holding arm 51 and the temporarily receiving portion 31. Additionally, the cam pin 88 enters the cam-pin introducing groove 22A and the cam groove 41, and the lock projection 89 enters the guide groove 22B.

Figure 3:
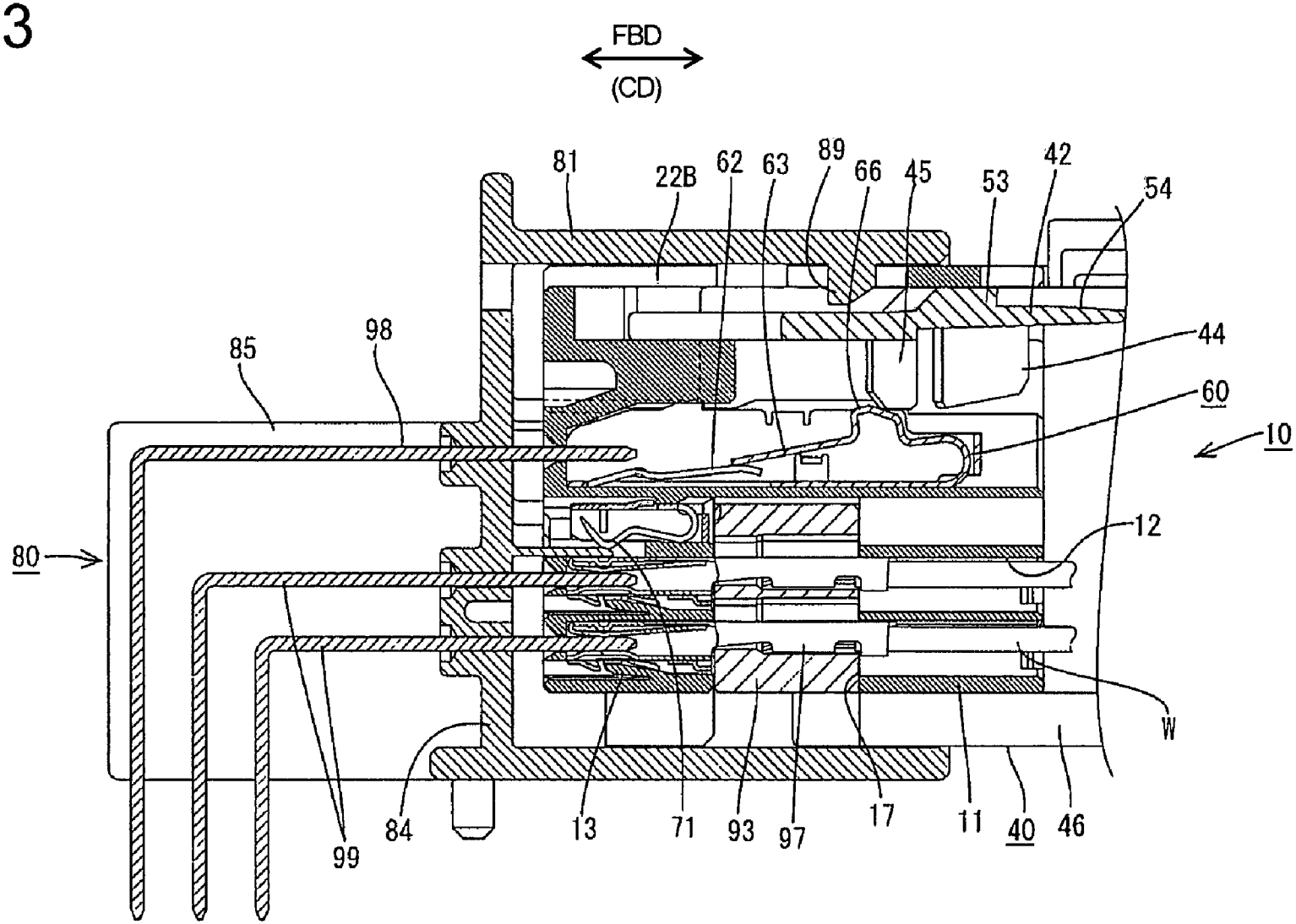
FIG. 3 is a side view in section of both housings showing a state where the pre-pressing portion presses the pressable portion.

The operating arm 49 then is pressed to rotate the lever 40 in a direction of arrow X shown in FIG. 8. The cam pin 88 moves along the cam-pin introducing groove 22A, the lock projection 89 moves along the guide groove 22B and the short canceling pieces 87 move between the resilient pieces 71 of the shorting terminals 70 and the female terminal fittings 97 at an initial stage of the rotation of the lever 40, as shown in FIG. 2, thereby canceling the shorted state. Further, the pre-pressing portion 45 contacts the pressable portion 66 of the detecting terminal 60 from behind at the initial state of the rotation of the lever 40, and the slants of the pre-pressing portion 45 and the pressable portion 66 slide on each other in the connecting direction CD of the housings 10, 80, to deform the second spring 63. The first springs 62 are pressed down and in as the front end of the second spring 63 inclines so that the contacts 65 of the first springs 62 become lower and more inward than the corresponding contact terminals 98, as shown in FIG. 3. In this way, the first springs 62 are pressed down and in at an early stage of the entrance of the contact terminals 98 into the detecting terminal 60, and the contact terminals 98 are inserted to the back of the detecting terminal 60 while separating from the contact portion 65.

Figure 4:
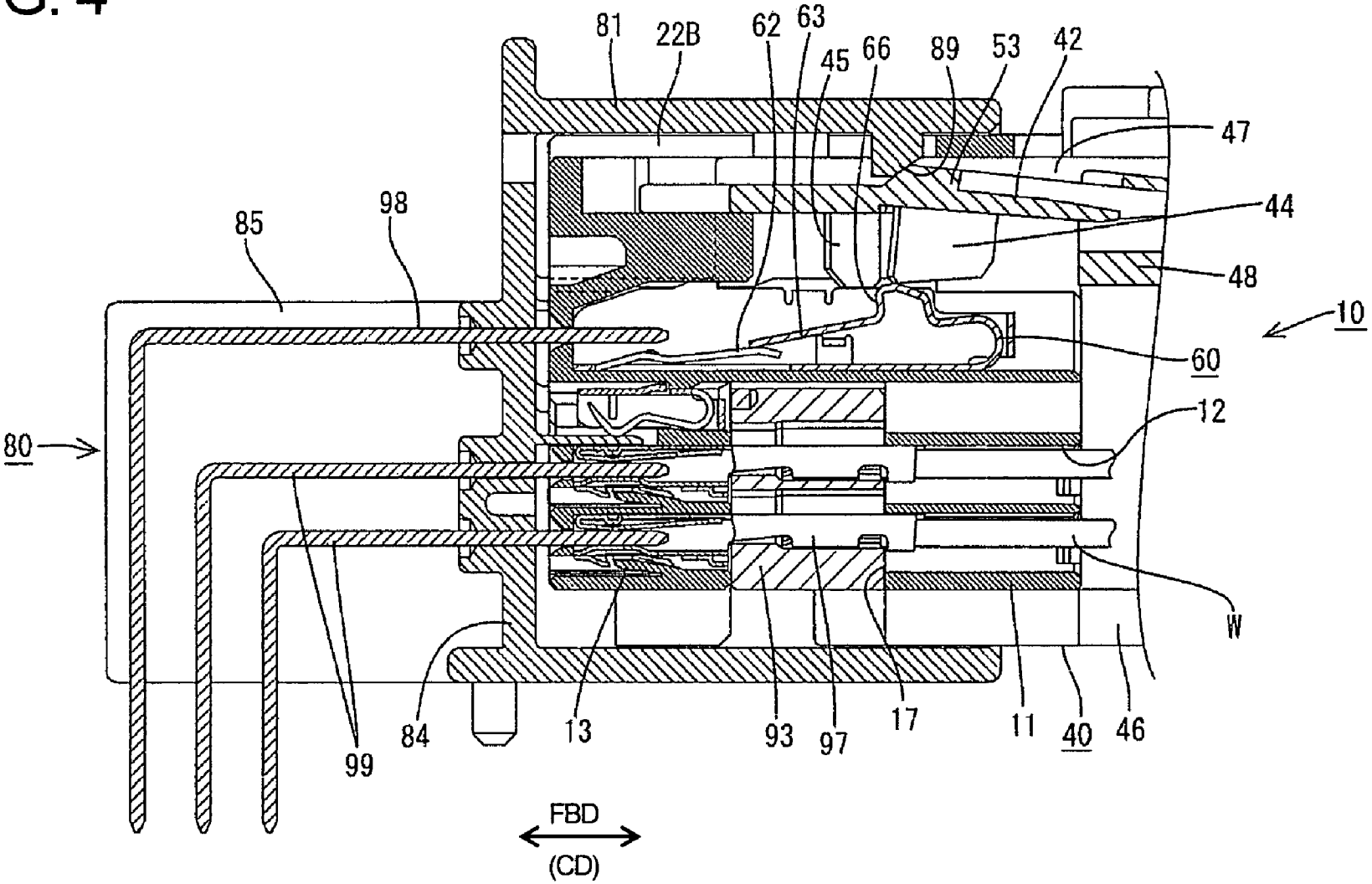
FIG. 4 is a side view in section of both housings showing a state where a pressing portion presses the pressable portion.
Figure 5:
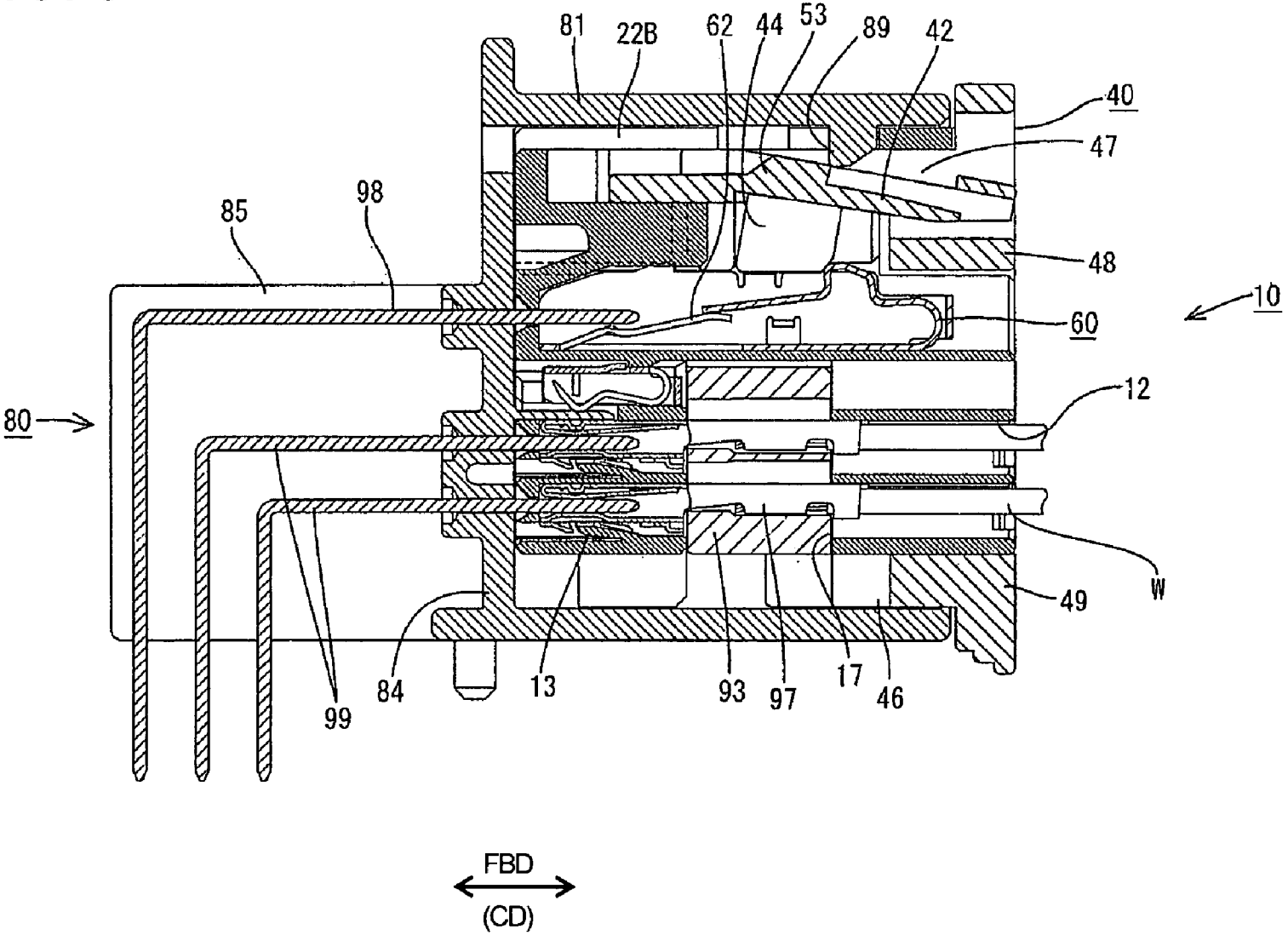
FIG. 5 is a side view in section of both housings showing immediately before a pressed state by the pressing portion is canceled.
Figure 9:
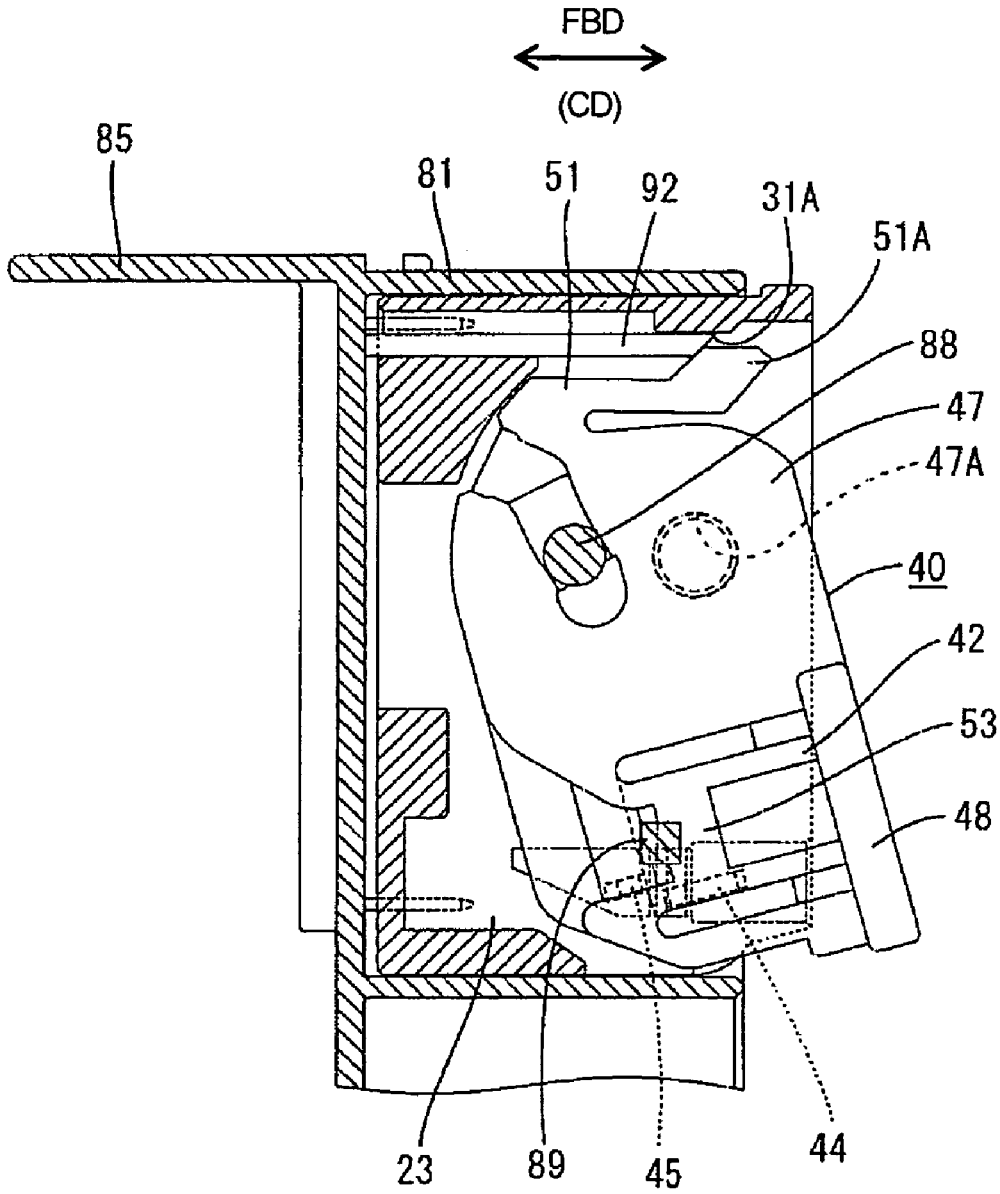
FIG. 9 is horizontal section of both housings during the connection.

The locking projection 53 of the locking piece 42 moves onto the lock projection 89 as the lever 40 is rotated further, and the locking piece 42 deforms down, as shown in FIG. 4. As a result, the pre-pressing portion 45 moves away from the pressable portion 66 and the front end of the pressing portion 44 presses the pressable portion 66 down. The second spring 63 remains deformed and does not restore resiliently up. Thus, the contacts 65 of the first springs 62 also do not restore resiliently up and remain separated from the contact terminals 98. As shown in FIGS. 5 and 9, the slant of the pressing portion 44 slides on the pressable portion 66 and simultaneously makes an arcuate movement along the rotational path of the lever 40, while the locking projection 53 is passing the lock projection 89. Thus, the first and second springs 62 and 63 remain deformed.

Figure 6:
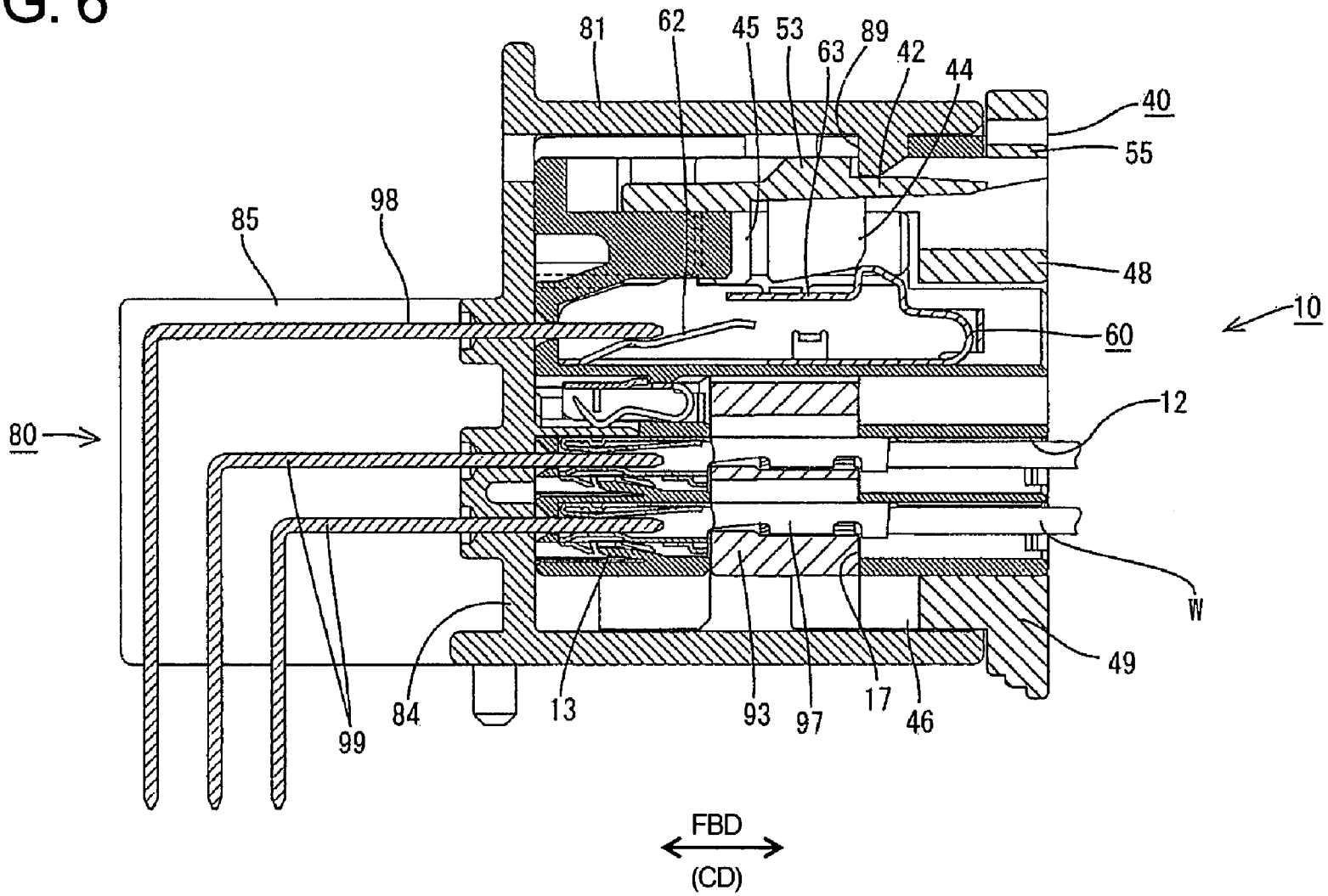
FIG. 6 is a side view in section of the housings with the pressing portion released upon the arrival of a lever at a connection ending position to establish contact of contact terminals and a detecting terminal.

The locking projection 53 of the locking piece 42 move over the lock projection 89, as shown in FIG. 6, when the lever 40 reaches the connection ending position CEP. Thus, the locking piece 42 restores resiliently towards its initial natural state and the pressing portion 44 moves away from the pressable portion 66 to substantially stop pressing. As a result, the first and second springs 62 and 63 are restored resiliently towards their initial natural states. The heights of the contacts 65 of the first springs 62 are raised to push the contact terminals 98 from below and to establish an electrical connection therebetween, thereby closing the detecting circuit. A signal resulting from the connection of the contact terminals 98 and the detecting terminal 60 is detected electrically to indicate that the lever 40 has reached the connection ending position CEP and that the housings 10, 80 have been connected properly. Additionally, a specified circuit is constructed by establishing an electrical connection between the male and female terminal fittings 99, 97.

The cam plate 47 is in the accommodating space 21 of the housing main body 11, the protecting portion 48 is in the protecting-portion accommodating space 21A, and the operation arm 49 is fit into the stepped recess 29B of the housing main body 11 when the lever 40 reaches the connection ending position CEP. Then, as shown in FIGS. 10 and 16, the rear ends of the lever 40 and the housing main body 11 are substantially flush with each other. The arrival of the lever 40 at the connection ending position CEP can be confirmed visually by this flush alignment.

Figure 12:
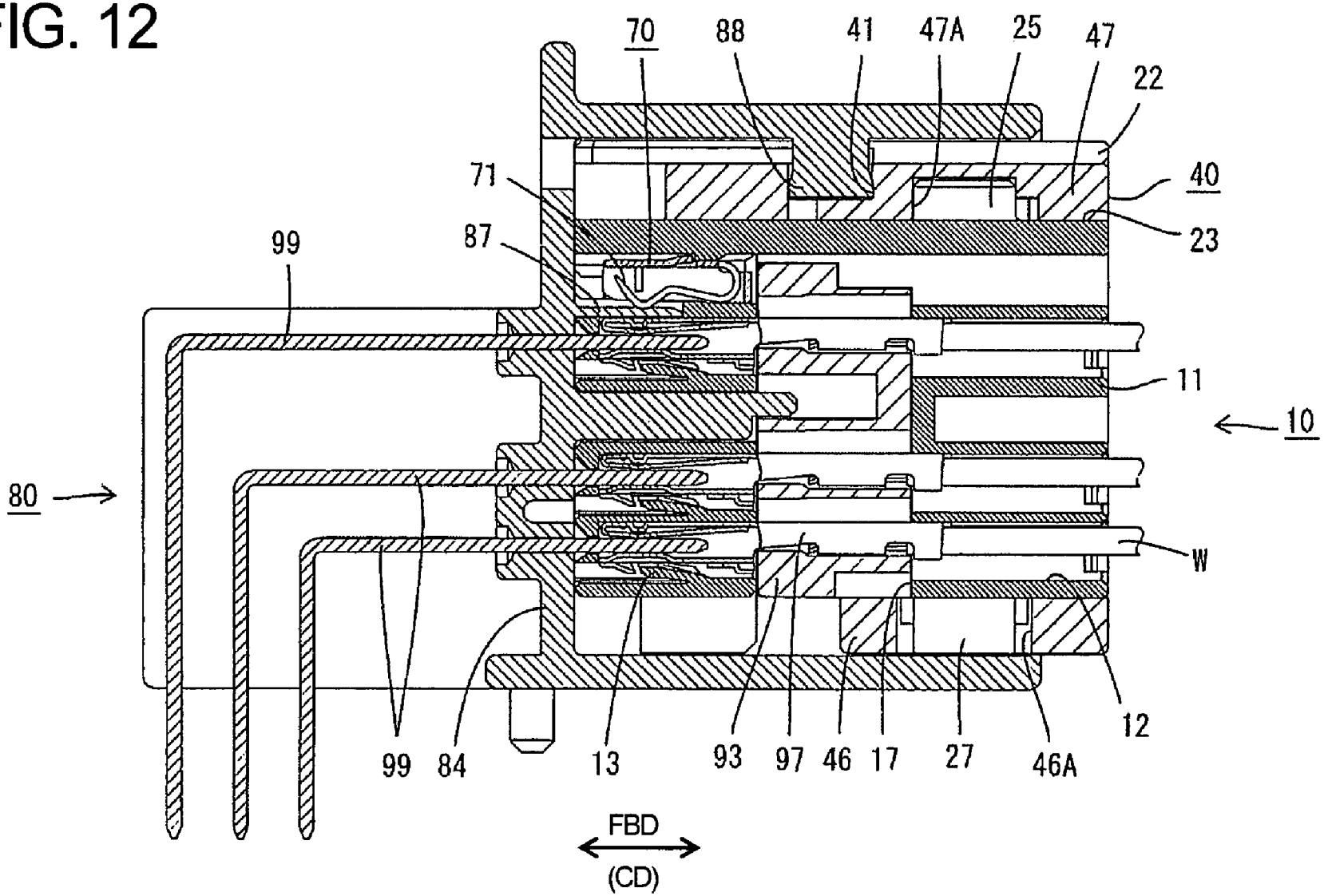
FIG. 12 is a side view in section of both housings properly connected with a cam pin and a cam groove located at an engaging position.

The central axis of rotation of the lever 40 is displaced in the width direction WD, and an engaging area of the cam groove 41 and the cam pin 88 is only in the one cam plate 47 of the lever 40, as shown in FIG. 12. Thus, a connecting force of the lever 40 is skewed to the central axis of rotation and to the engaging area of the cam groove 41 and the cam pin 88. Therefore, the connecting operation is likely to proceed faster at this side while being delayed at a side away from the central axis and opposite to the engaging area of the cam groove 41 and the cam pin 88. However, the hook 43 of the lever 40 hooks and pulls the receiving portion 91, as shown in FIG. 15, substantially immediately before the lever 40 reaches the connection ending position CEP even if the housings 10, 80 are inclined from their proper connecting postures with respect to the vertical direction. In this way, the connecting operation at the side of the posture correcting arm 46 proceeds faster. Therefore, the postures of both housings 10, 80 are corrected to proper connecting postures when the lever 40 reaches the connection ending position CEP.

Further, even if both housings 10, 80 are inclined from their proper connecting postures with respect to the width direction WD, the pushing surface 49A of the operation arm 49 of the lever 40 contacts the contact surface 29A of the housing main body 11 and pushes it toward the receptacle 81 substantially immediately before the lever 40 reaches the connection ending position CEP, as shown in FIG. 13. In this way, the connecting operation at the end away from the central axis, which is apt to delay, is caused to proceed faster. Therefore, the postures of both housings 10, 80 are corrected to proper connecting postures when the lever 40 reaches the connection ending position CEP.

Figure 14:
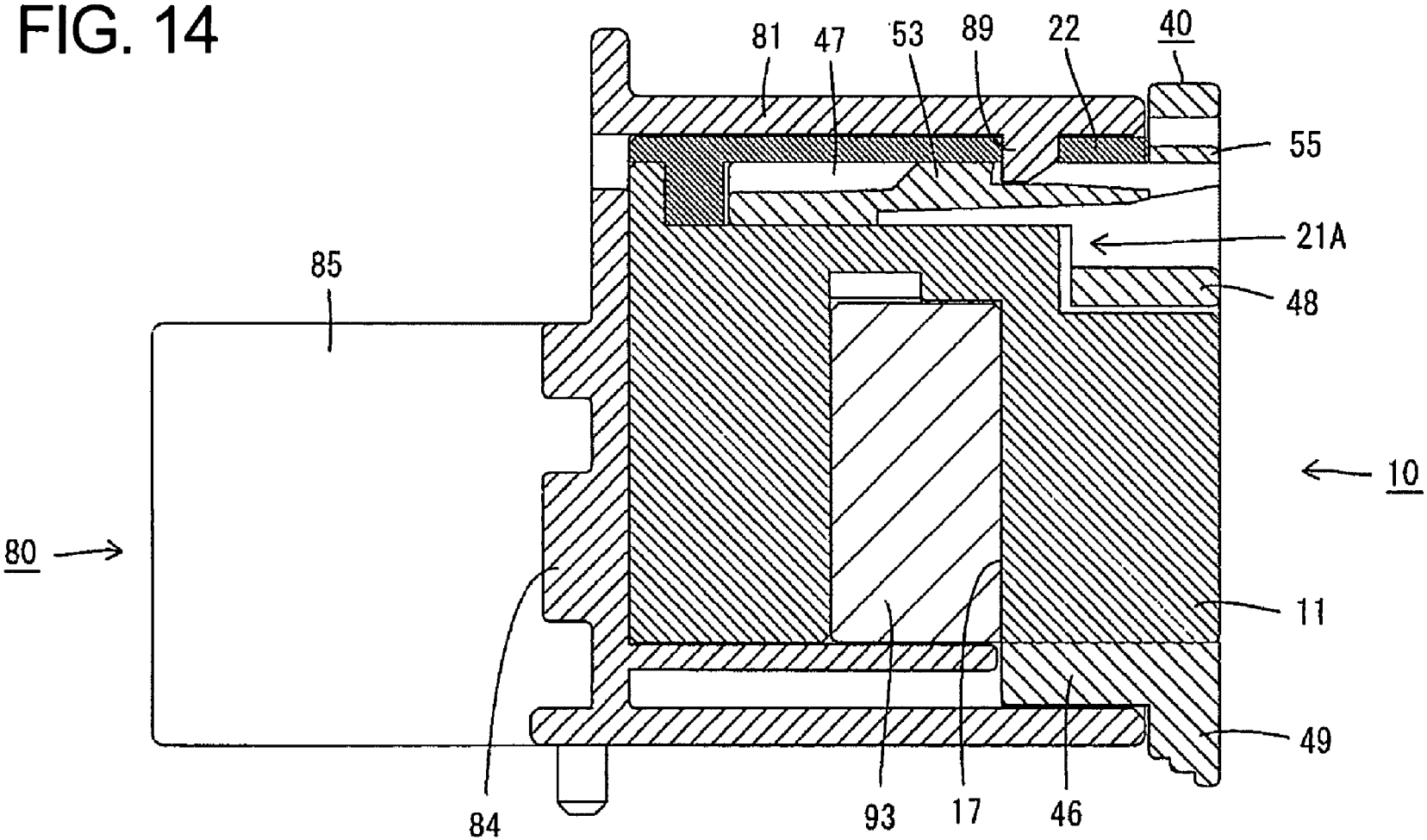
FIG. 14 is a side view in section of both housings properly connected showing a locking piece of the lever engaged with a lock projection.

The lock projection 89 slides in contact with the guide groove 22B of the housing main body 11 and the cam pin 88 likewise slides in contact with the cam-pin introducing groove 22A of the housing main body 11 while the housings 10, 80 are being connected. These sliding movements guide the connecting operation of both housings 10, 80 and further prevent inclined postures of the housings 10, 80. The lock projection 89 is between the back end of the guide groove 22B of the cover 22 of the housing main body 11 and the locking projection 53 of the locking piece 42 of the lever 40 when the lever 40 reaches the connection ending position CEP, as shown in FIG. 14. Thus, the locked state of the lever 40 indicates that the housings 10, 80 are in their proper connecting postures.

As described above, the pressing portion 44 on the lever 40 presses the detecting terminal 60 and separates the detecting terminal 60 from the contact terminals 98 while the housings 10, 80 are being connected. The pressing portion 44 stops pressing the detecting terminal 60 when the housings 10, 80 are connected properly by the rotation of the lever 40. Thus, the detecting terminal 60 is restored resiliently and contacts the contact terminals 98 to close the detecting circuit. In this way, the properly connected state of the housings 10, 80 is detected electrically in the lever-type connector.

The lock projection 89 deforms the locking piece 42 until the housings 10, 80 are connected properly. The pressing portion 44 is on the locking piece 42 and accordingly presses the detecting terminal 60 and keeps the detecting terminal 60 separated from the contact terminals 98. The locking piece 42 moves over the lock projection 89 and restores resiliently when the housings 10, 80 are connected properly and the pressing portion 44 substantially stops pressing the detecting terminal 60. Therefore the detecting terminal 60 is restored resiliently to establish an electrical contact with the contact terminals 98, thereby closing the detecting circuit.

Movements of the locking piece 42 during the connecting operation and resilient restoration upon completion of the connecting operation are utilized as an indicator of the proper connection of the housings 10, 80. Thus, there is no variation in detection due to an assembling error of the lever 40 and the properly connected state can be detected precisely as compared to the type in which the angular position of the lever 40 is detected and the detected angular position is used as an indicator of the proper connection.

If the resilient deformation of the locking piece 42 starts a while after the start of the connecting operation of the housings 10, 80, the detecting terminal 60 and the contact terminals 98 may be brought into contact during this time. However, the pre-pressing portion 45 holds the detecting terminal 60 and the contact terminals 98 separated from each other even until the start of the resilient deformation of the locking piece 42. Thus, proper connection is not detected mistakenly during the connecting operation. In other words, secure detection can be accomplished by enlarging the operation range where the connection detection can be made thereby improving overall operability.

The lever 40 has moved to the connection ending position CEP when the housings 10, 80 are connected completely and projects back from the female housing 10 by only a small amount. Hence the entire connector can be small. The pressing portion 44 of the lever 40 contacts the pressable portion 66 from behind with respect to the connecting direction CD as the lever 40 is rotated and slides forward thereon along the rotational path. The second spring 63 extends along the sliding direction and therefore can be deformed easily. Conversely, the first springs 62 extend backward and can be brought into contact with the contact terminals 98 with sufficient contact pressures at an early stage of the connecting operation.

A second embodiment of the invention is described with reference to FIGS. 27 to 34. The second embodiment differs from the first embodiment in that a movable arm 30 is between a pressing portion 44 and a detecting terminal 60, and the pressing portion 44 indirectly presses the detecting terminal 60 via the movable arm 30. The other construction is substantially the same as the first embodiment. Substantially identical elements are identified by the same reference numerals but are not described again.

The detecting terminal 60 has a base plate 61 to be arranged along the inner surface of a detecting-terminal accommodating portion 16, and a spring 63A of a specified shape is bent forward from the rear end of the base plate 61. The detecting terminal 60 has no part corresponding to the first springs 62 of the first embodiment. More specifically, the spring 63A is turned at the rear end of the base plate 61 to extend substantially horizontally forward, and then is bent to project up to form a pressable portion 66. The spring 63A extends obliquely down towards the front from the pressable portion 66 and then is bent to extend slightly up with a moderate inclination after. The leading end of the spring 63A is bent to extend obliquely down towards the front. This bent portion at or near the leading end defines a contact 65 with the contact terminal 98.

Similar to the first embodiment, a rearwardly open accommodating space 21 for a lever 40 is so formed between a covering wall 22 and a lever mounting surface 23 of a housing main body 11 of a female housing 10. A through hole 24 is formed in the wall having the lever mounting surface 23 at a position corresponding to the detecting-terminal accommodating portion 16.

A movable arm 30 is cantilevered backward from the upper end of a front wall 11A of the housing main body 11 and is resiliently deformable with the upper end of the front wall 11A as a support for deformation. The movable arm 30 is unitary to the housing main body 11, and includes an arm main body 32 that extends substantially horizontally in forward and backward directions FBD in the through hole 24 for partitioning the upper part of the detecting-terminal accommodating portion 16. A press-receiving portion 33 projects from the upper surface of the free rear end of the arm main body 32 and can be pressed by a pressing portion 44 and a pre-pressing portion 45 of a locking piece 42. The arm main body 32 has substantially the same thickness as the locking piece 42 of the lever 40 and is inclinable along the thickness direction thereof. A pressing rib 34 extend substantially from the front end to an intermediate position on the lower surface of the arm main body 32 and is capable of pressing the pressable portion 66 of the spring portion 63A of the detecting terminal 60 from above.

A reinforcing wall 11B is formed at the base end of the movable arm 30 substantially in correspondence with the upper part of the front wall of the detecting-terminal accommodating portion 16. The inner surface of the reinforcing wall 11B extends in forward and backward directions FBD and is not deformed by an inclining movement of the movable arm 30 for guiding the insertion of the contact terminals 98.

Similar to the first embodiment, the pressing portion 44 projects down from the locking piece 42 of the lever 40, and the pre-pressing portion 45 projects down before the pressing portion 44. The movable arm 30 is provided in a clearance to the detecting terminal 60. Thus, the pressing portion 44 and the pre-pressing portion 45 have a smaller projecting distance than those of the first embodiment. The front end of the pressing portion 44 projects substantially vertically and substantially normal to the forward and backward directions FBD. The bottom end of the pressing portion 44 extends substantially horizontally along the forward and backward directions FBD from the front end and then slopes up toward the back to define an escaping recess 44A into which the press-receiving portion 33 enters when the lever 40 reaches a connection ending position CEP. On the other hand, the front end of the pre-pressing portion 45 is sloped down towards the back. The bottom end of the pre-pressing portion 45 is a substantially horizontal flat surface that extends along the forward and backward directions FBD and the rear end of the pre-pressing portion 45 stands substantially vertically up normal to the forward and backward directions FBD. A slant corresponding to the front end of the pre-pressing portion 45 is formed at the rear end of the press-receiving portion 33, so that the arm main body 32 of the movable arm 30 can be inclined smoothly by the sliding contact of these two slants.

Contact terminals 98 enter the detecting terminal 60 as the lever 40 is rotated. Thus, the pre-pressing portion 45 and the pressing portion 44 successively contact the press-receiving portion 33 from behind as the lever 40 is rotated to displace the movable arm 30 down. The pressing rib 34 of the movable arm 30 presses the spring 63A to displace the contact portion 65 down and to separate the contact portion 65 of the spring portion 63A of the detecting terminal 60 from the contact terminals 98. The locking piece 42 is restored resiliently when the lever 40 reaches the connection ending position CEP and the spring 63A stops pressing the movable arm 30. As a result, the spring 63A is restored resiliently to bring contact portion 65 of the spring 63A of the detecting terminal 60 into contact with the contact terminals 98, thereby closing a detecting circuit.

The retainer 93 and the lever 40 and other parts are mounted prior to connecting the housings 10, 80, in substantially the same procedure as in the first embodiment. The lever 40 is at a connection starting position CSP and projects back from the rear end of the housing main body 11.

Figure 27:
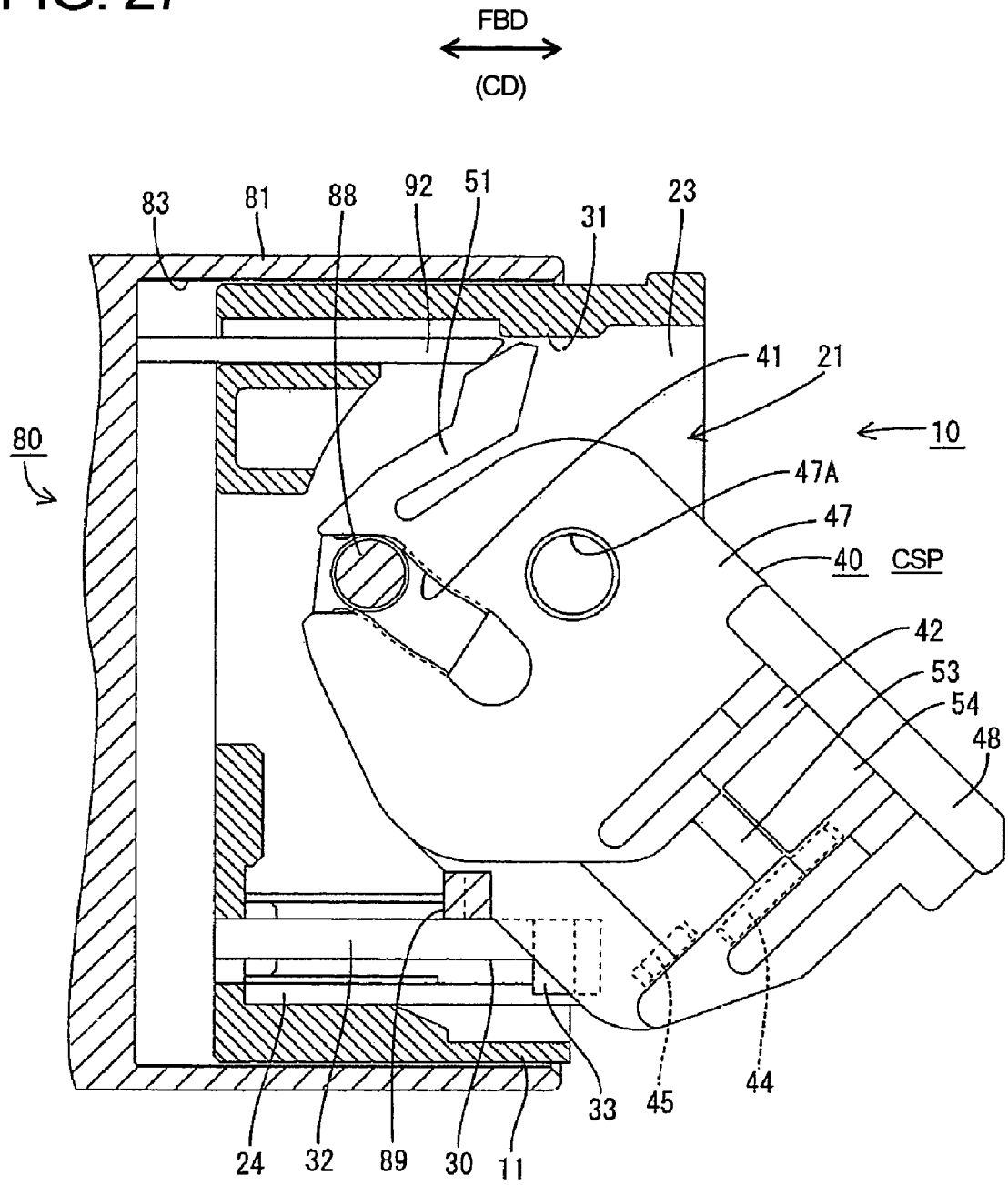
FIG. 27 is a horizontal section of a second embodiment showing a state where a female housing is fit into a receptacle of a male housing.
Figure 28:
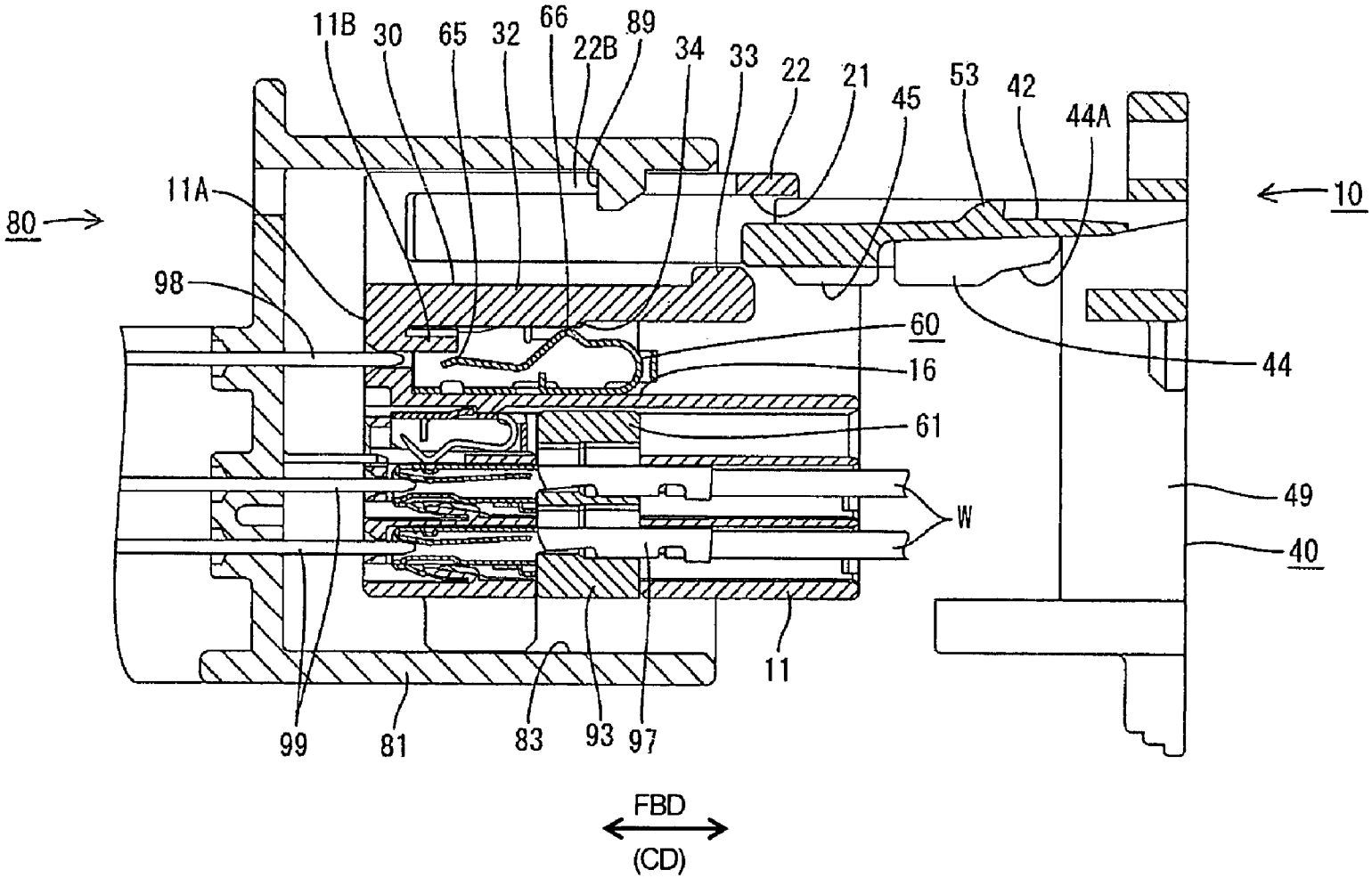
FIG. 28 is a side view in section showing the state of FIG. 27.

As shown in FIGS. 27 and 28, a front portion of the female housing 10 is fit into the fitting recess 83 of the receptacle 81 of the male connector housing 80. Thus, a disengaging projection 92 moves between and separates a temporary holding arm 51 and a temporary receiving portion 31. Additionally, the cam pin 88 enters the cam groove 41 and the lock projection 89 enters the guide grooves 22B.

Figure 29:
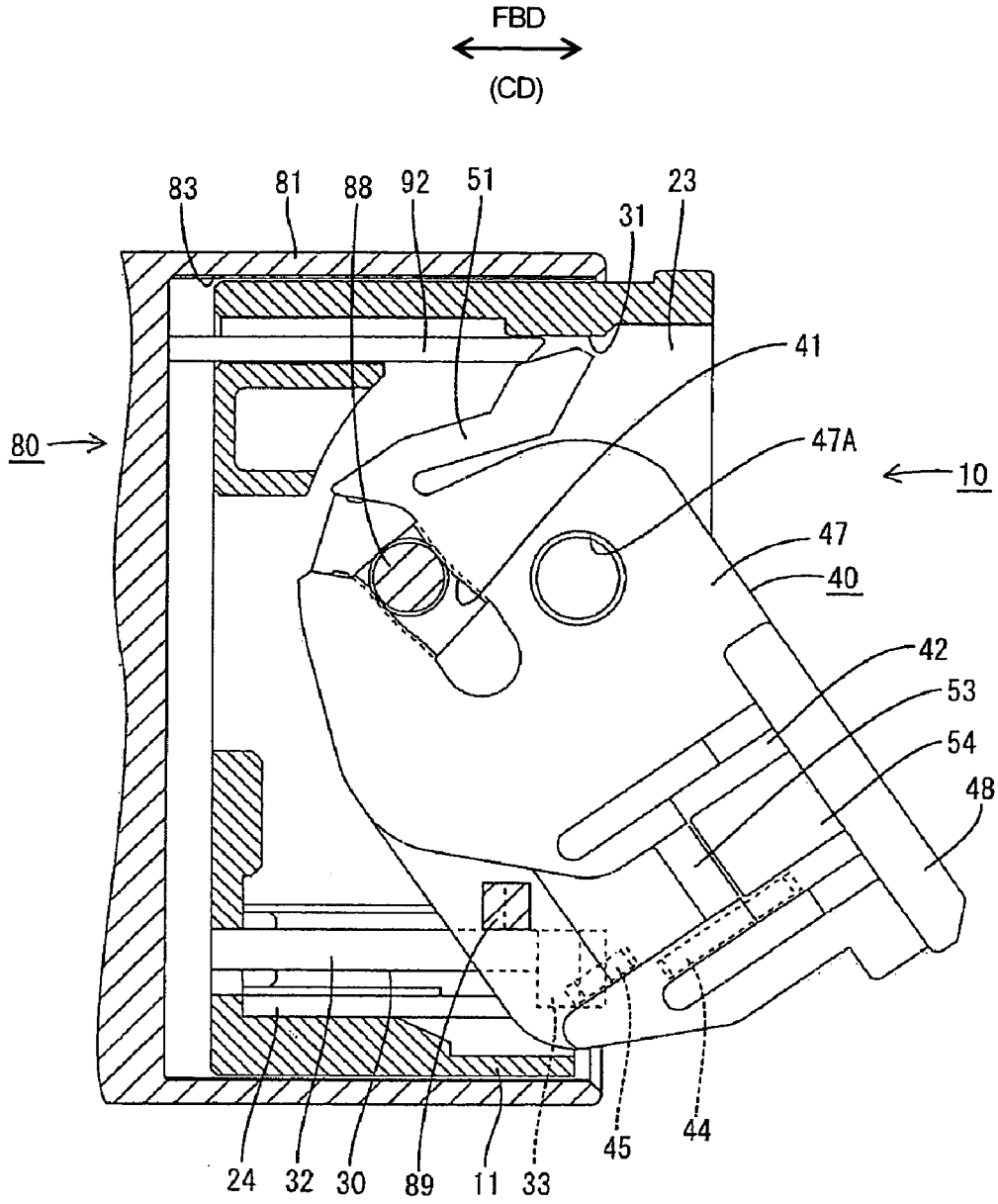
FIG. 29 is a horizontal section showing a lever rotated to a position so that a press-receiving portion of a movable arm is at a position corresponding to a pre-pressing portion.
Figure 30:
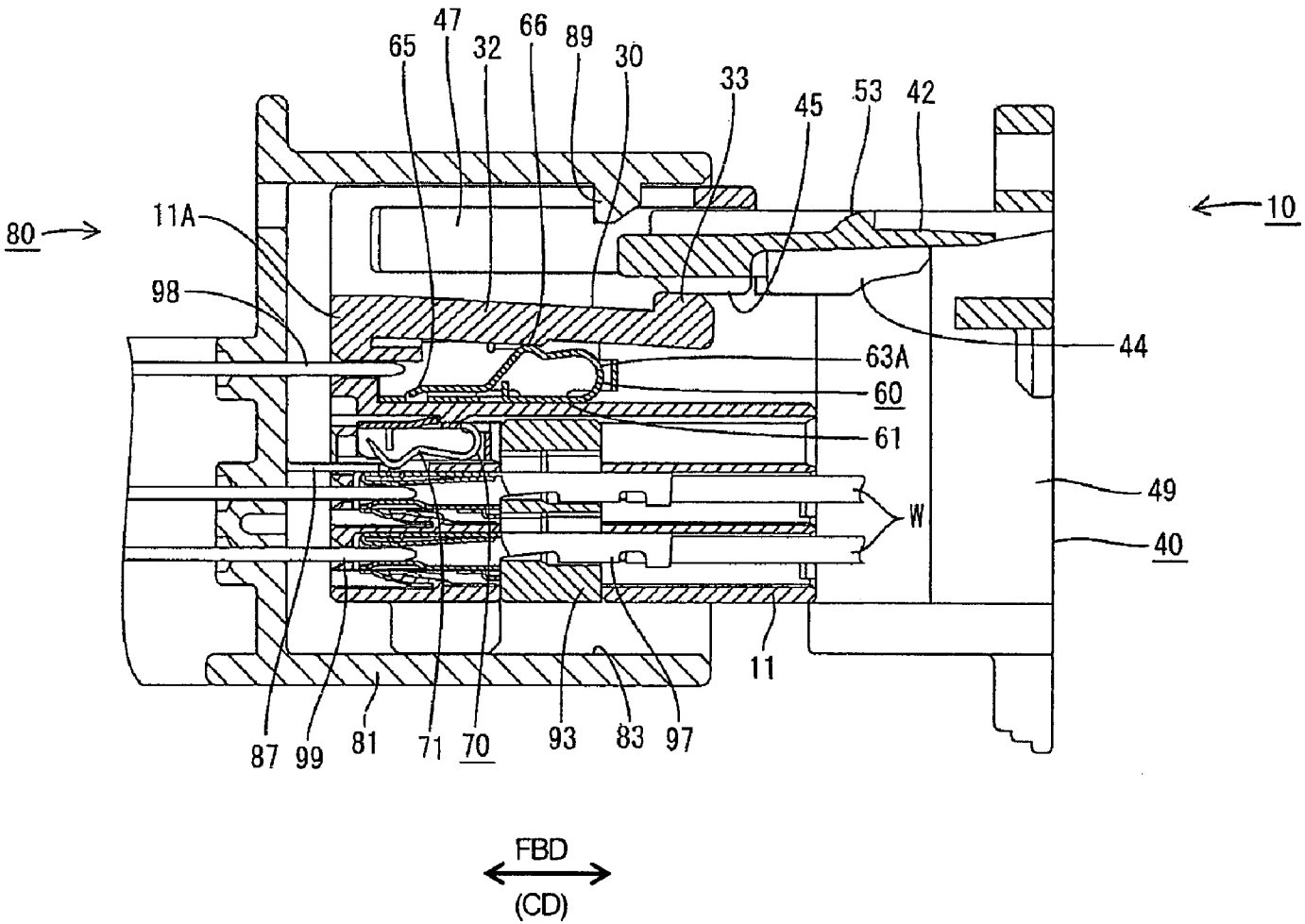
FIG. 30 is a side view in section showing the state of FIG. 29.

The lever 40 then is rotated by exerting forces on the operation arm 49. Thus, the cam pin 88 moves along the cam groove 41 and the short-canceling pieces 87 move between the resilient pieces 71 of the shorting terminals 70 and the female terminal fittings 97 to cancel the shorted state of the pairs of adjacent female terminal fittings 97, as shown in FIGS. 29 and 30. The pre-pressing portion 45 contacts the press-receiving portion 33 of the movable arm 30 from behind at an initial stage of the rotation of the lever 40. Thus, the free end of the movable arm 30 is deformed down while the slants of the pre-pressing portion 45 and the press-receiving portion 33 slide on each other in a connecting direction CD. Therefore, the spring 63A is pressed by the movable arm 30 and deforms down. In this way, the height of the contact portion 65 of the spring 63A becomes lower than that of the contact terminals 98 to enter the detecting terminal 60. Accordingly, the contact terminals 98 can move in the connecting direction without contacting the spring 63A. The pressed position of the spring 63A achieved by the movable arm 30 is kept substantially constant.

Figure 31:
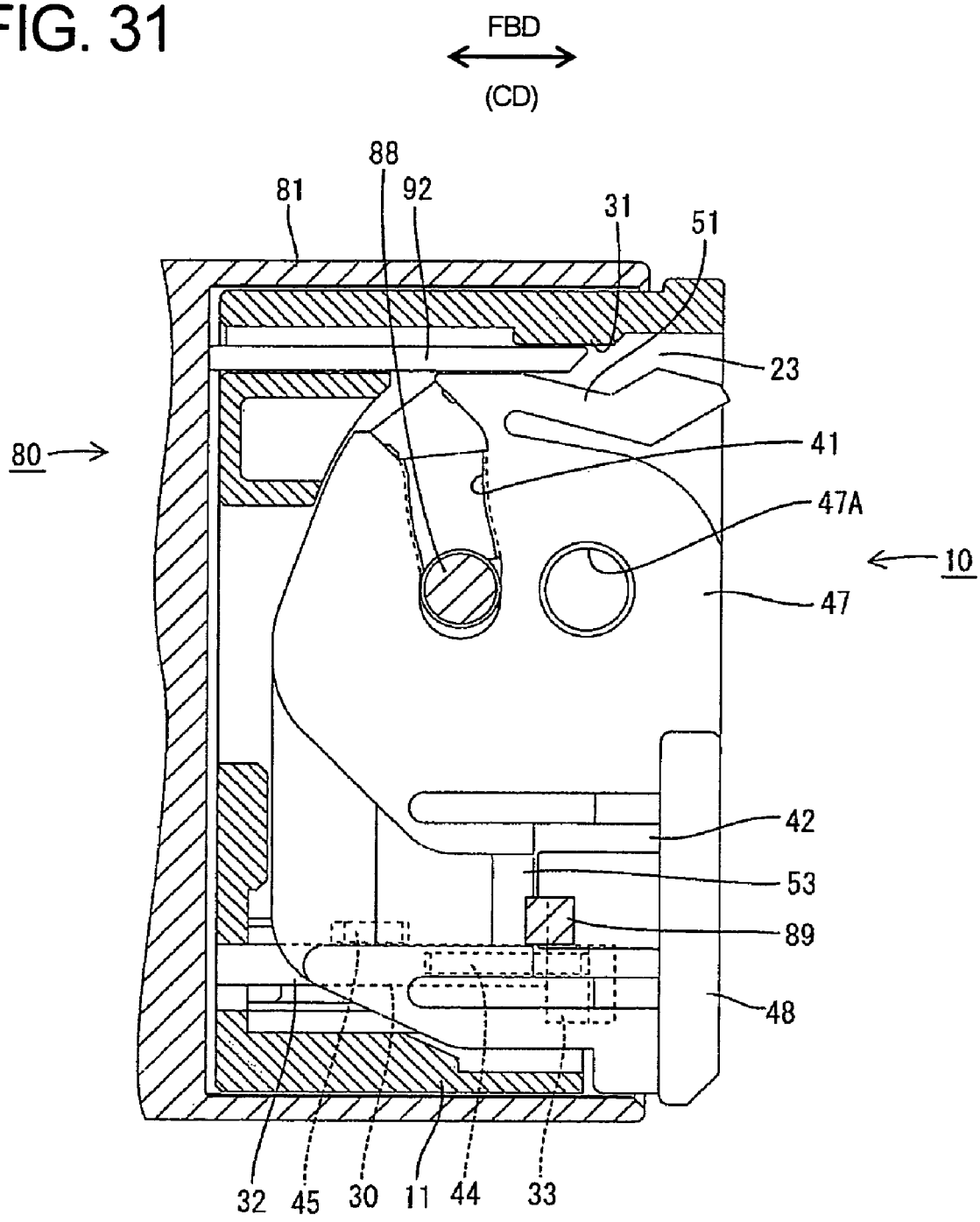
FIG. 31 is a horizontal section showing a lever rotated so that a locking projection of a locking piece moves onto a lock projection.
Figure 32:
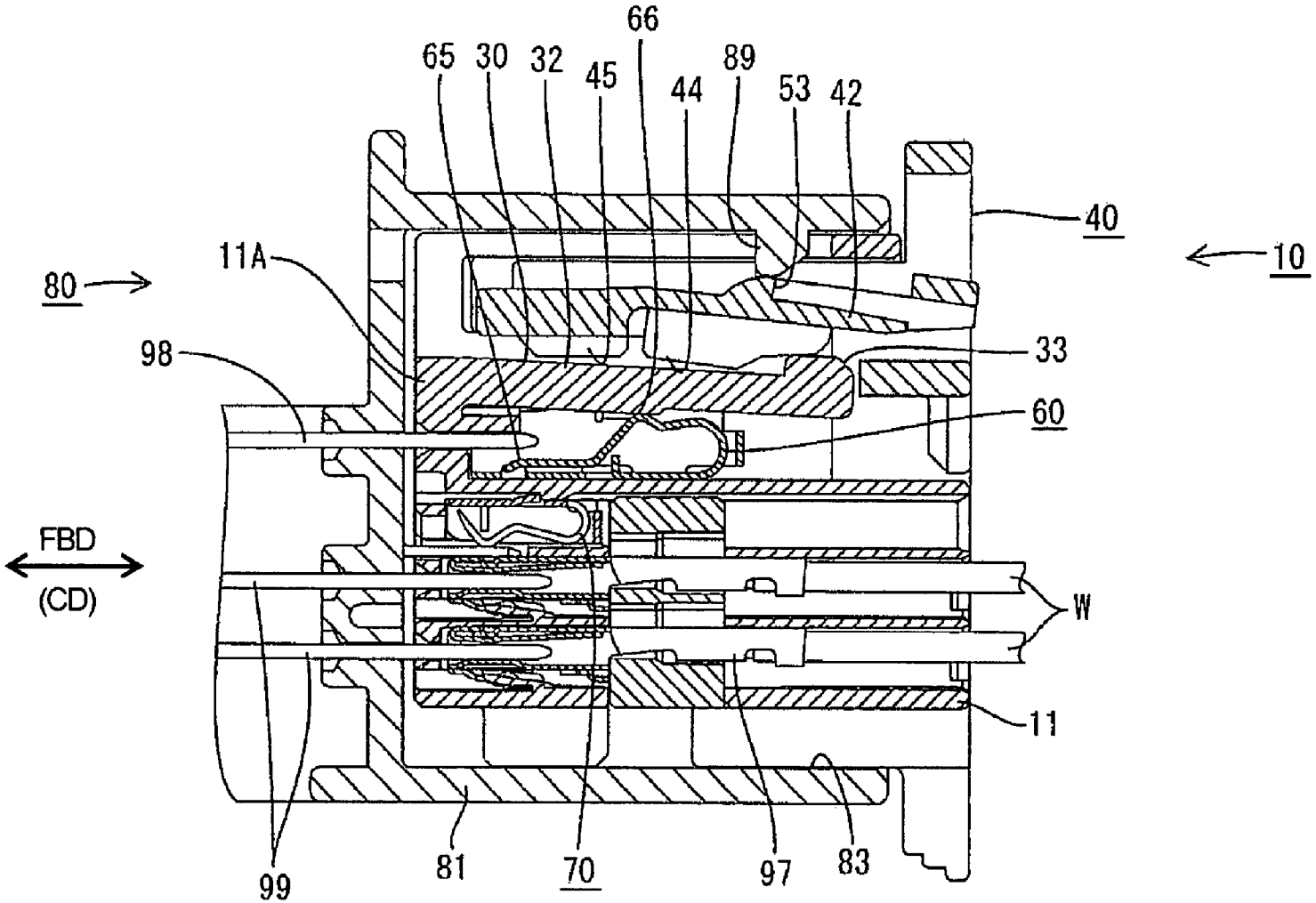
FIG. 32 is a side view in section showing the state of FIG. 31.

The lever 40 is rotated to a connection final position. As a result, the locking projection 53 of the locking piece 42 moves onto the lock projection 89 to resiliently deform the locking piece 42 down as shown in FIGS. 31 and 32. At this time, the pre-pressing portion 45 is already moved to a forward position away from the press-receiving portion 33. However, the pressing portion 44 presses the press-receiving portion 33 down and slides on the outer surface of the press-receiving portion 33. The pressed state of the press-receiving portion 33 by the pre-pressing portion 45 is transferred to the pressing portion 44 without interruption. Thus, the spring 63A remains deformed and the contact 65 of the spring 63A of the contact terminals 98 is separated from the detecting terminal 60.

Figure 33:
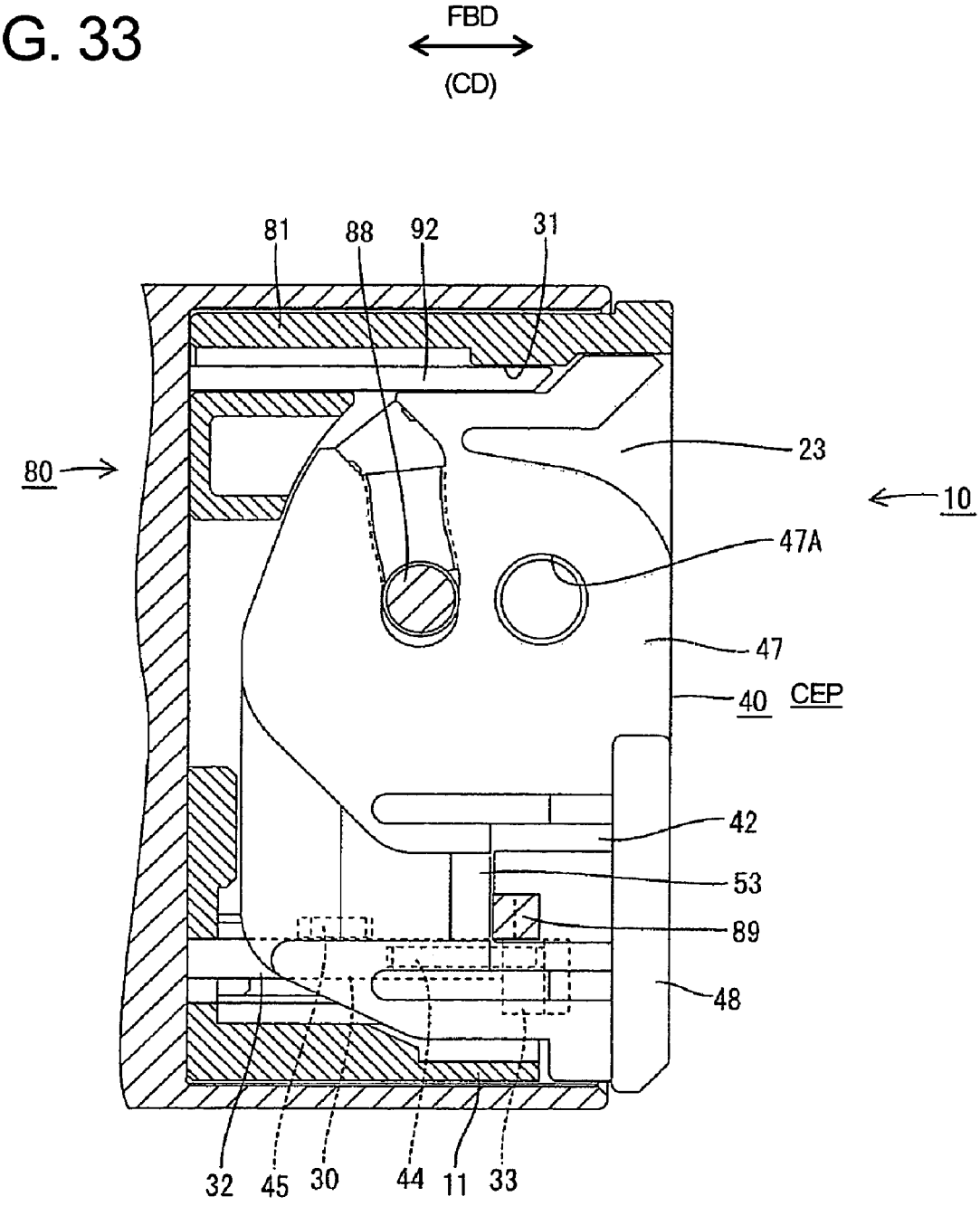
FIG. 33 is a horizontal section showing the lever at a connection ending position and both housings connected properly.
Figure 34:
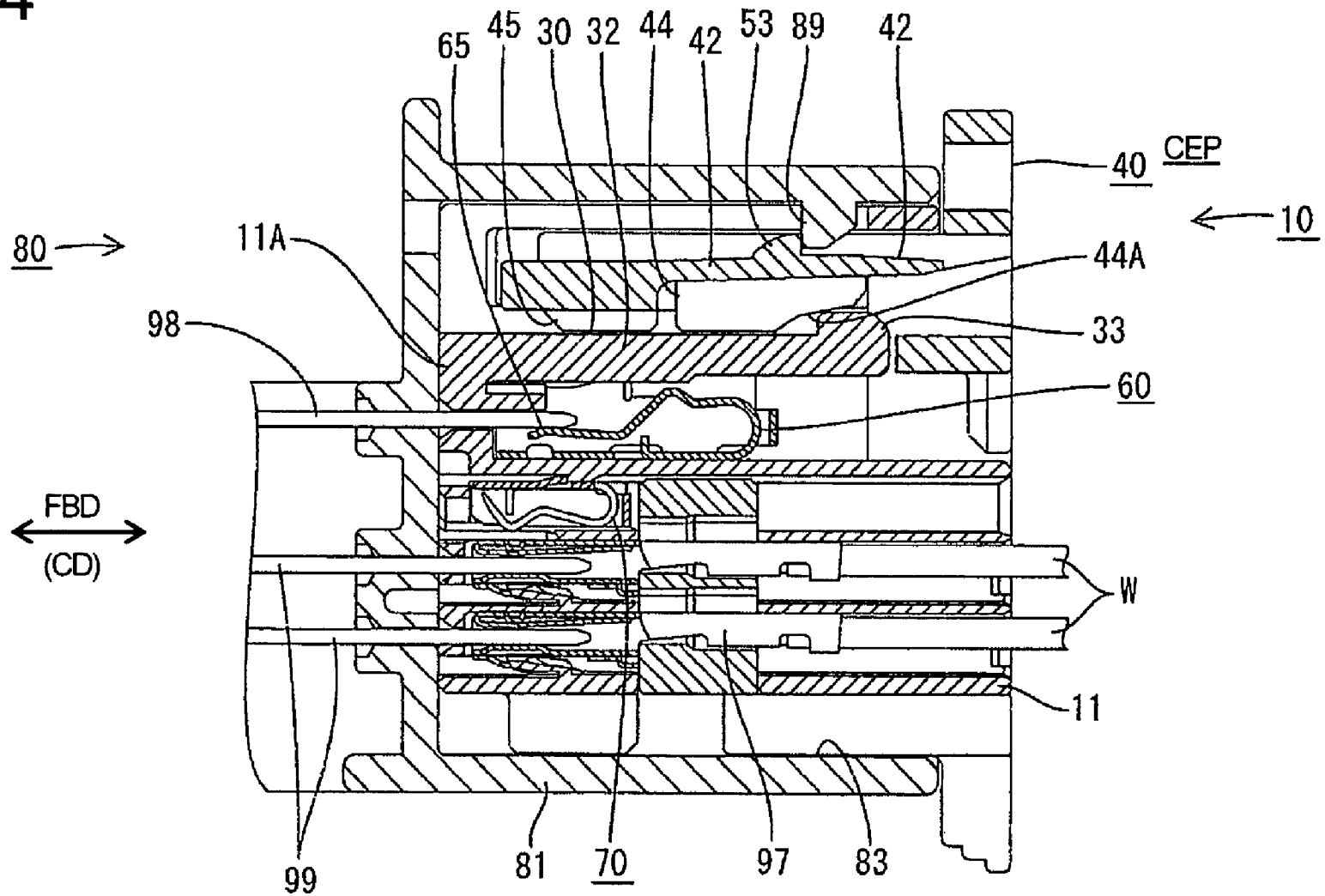
FIG. 34 is a side view in section showing the state of FIG. 33.

The locking projection 53 of the locking piece 42 moves over the lock projection 89 when the lever 40 reaches the connection ending position CEP shown in FIGS. 33 and 34. Thus, the locking piece 42 returns towards its initial natural state and, accordingly, the pressing portion 44 moves away from the press-receiving portion 33. The movable arm 30 likewise returns towards its natural state and the spring 63A, freed from the pressing by the movable arm 30, resiliently returns. The height of the contact 65 is raised when the spring 63A returns. Hence the contact 65 is pressed against the contact terminals 98 from below to establish an electrical connection between the contact 65 and the contact terminals 98 and to close the detecting circuit. The connection between the contact terminals 98 and the detecting terminal 60 produces an electrical signal to indicate that the lever 40 has reached the connection ending position and that both housings 10, 80 have been connected properly. Of course, female and male terminal fittings 97, 99 also are connected electrically. The pre-pressing portion 45 and the pressing portion 44 are arranged along the upper surface of the arm main body 32 and overlap the press-receiving portion 33 in the connecting direction CD when the lever 40 reaches the connection ending position CEP. Thus, the press-receiving portion 33 enters the escaping recess 44A of the pressing portion 44 to be located in the proximity of the stepped slanted surface.

According to the second embodiment, the movable arm 30 is between the detecting terminal 60 and the pressing portion 44 to press the detecting terminal 60. Therefore the pressing portion 44 does not directly press the detecting terminal 60. As a result, the pressed position of the detecting terminal 60 by the movable arm 30 can be kept substantially constantly at a specified position, and the detecting terminal 60 can be deformed in a well-balanced manner. Even in cases where the pressing portion 44 cannot reach a position to contact the detecting terminal 60 due to restriction on the structural space, such a problem can be dealt with by providing the movable arm 30.

The pressable portion 66 of the detecting terminal 60 could in a front area of the female housing 10 and the pressing portion 44 could be displaceable only in a rear area of the female housing 10 without being movable to the front area. However, even in such cases, the movable arm 30 inclined by an amount corresponding to the resiliently deformation of the pressing portion 44 can contact the pressable portion 66 of the detecting terminal 60 in the front area of the female housing 10 by providing the movable arm 30 between the pressing portion 44 and the detecting terminal 60 and setting the supporting point of inclination of the movable arm 30 on the front wall 11A of the female housing 10. Accordingly, the resiliently deformed state of the detecting terminal 60 can be held precisely by the movable arm 30 during the rotation of the lever 40.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The contact terminals can be assembled into the housing where the detecting terminal is provided, i.e. into the female housing.

The lever or any other movable member and/or the detecting terminal may be assembled into the male housing.

The lever may not be have the pre-pressing portion if the contact terminal and the detecting terminal can be held separated from each other only by the pressing portion.

The above-described operable member is a rotatable lever. However, the operable member may be displaceable along a different path e.g. linearly displaceable like a slider or follow any other path (such as a substantially elliptical, bent or other non-linear path).

The operable member may be provided with two or more cam plates engageable with a corresponding number of cam pins on the housing. The cam plates may be arranged in a non-symmetric manner with respect to the housing (e.g. displaced with respect to the widthwise central axis of the both connector housings and/or with respect to the heightwise central axis of the both connector housings).

What is claimed is:

1. A connector comprising:

a housing;

a mating housing connectable with the housing, the mating housing being formed with a mating cam;

a contact terminal in the housing or the mating housing;

a detecting terminal in the housing and being engageable with the contact terminal to close a detecting circuit; and a movable member formed separately from the housing and mounted on the housing for movement relative to the housing, the movable member being formed with a cam engageable with the mating cam on the mating housing, the cam and the mating cam being configured such that movement of the movable member relative to the housing urges the housing into connection with the mating housing in response to movement of the movable member, a pressing portion on the movable member for pressing and resiliently displacing the detecting terminal to a position away from the contact terminal while the movable member is being moved to connect the housings, while stopping pressing so that the detecting terminal can restore and contact the contact terminal when the movable member is moved sufficiently to connect the housings properly, whereby closing of the detecting circuit electrically detects proper connection of the housing with the mating housing.

2. The connector of claim 1, wherein the movable member has a resiliently deformable locking piece, the locking piece moving onto a lock projection in the mating housing during connection of the housings, while moving over the lock projection and being restored to engage the lock projection when the housings are connected properly, the pressing portion being on the locking piece.

3. The connector of claim 2, wherein the locking piece is disposed to start moving onto the lock projection and to deform resiliently at an intermediate stage of the connection of the housings, and a pre-pressing portion provided at a side of the movable member before the locking piece with respect to a connecting direction and being configured for pressing the detecting terminal, the pre-pressing portion holding the detecting terminal separated from the contact terminal before the pressing portion presses the detecting terminal.

4. The connector of claim 1, wherein the detecting terminal is assembled into the housing substantially along a connecting direction of the housing with the mating housing and the contact terminal being in the mating housing, the detecting terminal having a base plate for fixing the detecting terminal to the housing, a resiliently deformable first spring extending back from a front end of the base plate and being engageable with the contact terminal, and a resiliently deformable second spring extending forward from a rear end of the base plate, a front end of the second spring being placed on a rear end of the first spring at a side towards the movable member and a pressable portion at a longitudinal intermediate position of the second spring and disposed to be pressed by the pressing portion, the pressing portion pressing the pressable portion while sliding on the pressable portion along a rear to front movement path when the movable member is displaced from an initial position, where a backward projecting amount of the movable member from the housing is large, to a connection ending position, where the projecting amount is small.

5. A connector, comprising:

a housing connectable with a mating housing, a movable member movably mounted on the housing and formed with a cam engageable with a mating cam on the mating housing, and a detecting terminal contacting a contact terminal in the housing or the mating housing to close a detecting circuit only when the housings are connected properly for electrically detecting the proper connection;

at least one pressing portion formed on the movable member at a side where the detecting terminal is located;

a resiliently deformable movable arm provided in the housing between the pressing portion and the detecting terminal;

the pressing portion being configured to press and incline the movable arm towards the detecting terminal while the movable member is moved towards a position where the housings are connected properly, the inclined movable arm being configured to press and deform the detecting terminal away from the contact terminal; and the pressing portion further being configured to permit the movable arm to restore at least partly when the movable member is moved sufficiently to connect the housings properly, and thereby permitting the detecting terminal to be restored resiliently sufficiently to contact the contact terminal.

6. The connector of claim 5, wherein the movable member is moved from an initial position where the movable member projects back by a long distance from the housing to a connection ending position where the movable member projects by a short distance.

7. The connector of claim 5, wherein the movable member includes at least one locking piece resiliently deformable along a thickness direction of the movable member, the locking piece being displaced by moving onto at least one lock projection formed in the mating housing during a connection of the housings while being restored upon moving over the lock projection when the housings are connected properly.

8. The connector of claim 7, wherein the pressing portion is on a surface of the locking piece substantially facing the movable arm, and the movable arm extends back from a support substantially at a front end of the housing, a press-receiving portion at a rear end of the movable arm and configured to be pressed by the pressing portion.

9. The connector of claim 5, wherein:

the movable member comprises at least one posture correcting arm arranged rotatably and substantially concentrically with a cam plate of the movable member on a surface of the housing substantially opposite to a surface of the housing on which the cam plate is provided with respect to the height direction of the housing, and an operation arm connecting the posture correcting arm and the cam plate and used to rotate the movable member, the posture correcting arm further being formed with at least one hook for engaging a receiving portion in the mating housing and producing forces to pull the housings towards each other during connection of the housings.

10. A connector comprising:

a housing;

a detecting terminal mounted in the housing, the detecting terminal has a base plate for fixing the detecting terminal to the housing, a resiliently deformable first spring extending back from a front end of the base plate and a resiliently deformable second spring extending forward from a rear end of the base plate, a front end of the second spring being placed on a rear end of the first spring at a side towards the movable member and a pressable portion at a longitudinal intermediate position of the second spring; and a movable member mounted on the housing for movement between a connection starting position and a connection ending position, the movable member being formed with a pressing portion arranged at a part of the movable member for pressing and resiliently displacing the detecting terminal during movement of the movable member from the connection starting position to the connection ending position and for stopping pressing so that the detecting terminal can restore resiliently when the movable member is at the connection ending position, wherein the pressing portion is disposed for pressing the pressable portion while sliding on the pressable portion along a rear to front movement path when the movable member is displaced from the connection starting position to the connection ending position.

11. A connector comprising:

a housing;

a detecting terminal mounted in the housing; and a movable member mounted on the housing for movement between a connection starting position and a connection ending position, the movable member being formed with a pressing portion arranged at a part of the movable member for pressing and resiliently displacing the detecting terminal during movement of the movable member from the connection starting position to the connection ending position and for stopping pressing so that the detecting terminal can restore resiliently when the movable member is at the connection ending position, wherein the movable member comprises a cam plate rotatably mounted on a first side of the housing and formed with a cam groove, a posture correcting arm rotatably mounted on a second side of the housing substantially opposite the first side and aligned substantially parallel to the cam plate, and an operation arm connecting the posture correcting arm and the cam plate and used to rotate the movable member.

12. The connector of claim 11, wherein the operation arm projects from the housing when the movable member is at the connection starting position and is substantially flush with the housing when the movable member is at the connection ending position.

13. The connector of claim 12, wherein the cam plate of the movable member includes a locking piece that is resiliently deformable along a thickness direction of the cam plate, the pressing portion being on a surface of the locking piece.

* * * * *